US005918432A

United States Patent [19]

Mahone et al.

[11] Patent Number: 5,918,432

[45] Date of Patent: Jul. 6, 1999

[54] SHELVING SYSTEM AND COMPONENTS THEREOF

[76] Inventors: Mark D Mahone, 660 C Baywood La., Wood Ranch, Calif. 93065; Harold J Erbs, 5130 Braesheather, Houston, Tex. 77096-4106

[21] Appl. No.: 08/787,608

[22] Filed: Jan. 23, 1997

[51] Int. Cl.[6] ..... E04C 2/52

[52] U.S. Cl. ..... 52/220.2; 52/36.5

[58] Field of Search ..... 52/220.2, 220.7, 52/36.4, 36.5, 36.6

[56] References Cited

U.S. PATENT DOCUMENTS

| | | | |
|---|---|---|---|
| 4,116,509 | 9/1978 | Smith . | |
| 4,232,183 | 11/1980 | Person . | |
| 4,682,457 | 7/1987 | Spencer | 52/220.7 X |
| 4,891,920 | 1/1990 | Pingston | 52/220.7 X |
| 5,038,539 | 8/1991 | Kelley et al. . | |
| 5,069,408 | 12/1991 | Bessinger . | |
| 5,212,915 | 5/1993 | Antonio . | |
| 5,277,393 | 1/1994 | Nicholson et al. . | |
| 5,297,486 | 3/1994 | Herrmann et al. . | |
| 5,372,265 | 12/1994 | Mönch . | |
| 5,394,658 | 3/1995 | Schreiner et al. | 52/220.7 X |
| 5,405,114 | 4/1995 | Dias | 52/36.6 X |
| 5,511,348 | 4/1996 | Cornell et al. | 52/220.7 X |
| 5,672,228 | 9/1997 | Macander et al. | 52/144 X |
| 5,685,113 | 11/1997 | Reuter et al. | 52/220.7 |

*Primary Examiner*—Creighton Smith
*Attorney, Agent, or Firm*—Lyon & Lyon LLP

[57] ABSTRACT

A modular shelving system that includes framework which provides structural integrity and distribution of electrical wiring, communication, data transmission and other services, and brackets and shelves which may be interlocked for stability purposes. The shelves exhibit increased strength to provide greater shelf spans between framework supports. The shelving system is suitable for universal application in laboratories, clean rooms and other rooms, and may also constitute a self-standing structure on which a room may be built.

6 Claims, 17 Drawing Sheets

SHELVING SYSTEM AND COMPONENTS THEREOF

I. FIELD OF THE INVENTION

The field of the invention relates generally to shelving systems and associated framework, brackets, shelves and other components, and more particularly, to shelving systems which provide modularity, liquid and instrument containment, services distribution and/or self-standing configurations, increased strength and protection. Such systems are suitable for the wide variety of laboratory applications which exist today, as well as any other room or application requiring an improved shelving system.

II. BACKGROUND OF THE INVENTION

In recent years, laboratories, clean rooms, processing and other types of rooms have had to serve an increasing number of functions. Consequently, the shelving systems used in such environments have had to provide adaptability to address changing needs. Besides laboratories and the like however, improved shelving has also become necessary in other situations such as storage warehouses, food processing rooms and other various locations and applications.

For example, the increased role of computers, computer networks, instrumentation, test apparatus, control systems and other equipment in current research and development indicates that laboratory shelving systems should properly and efficiently accommodate such equipment. For example, it is desirable that shelving systems protect such equipment against damage from chemical spills, accidents such as earthquakes or other damaging situations.

However, existing shelving systems are typically not designed to protect equipment such as computers and other delicate equipment. For example, a chemical spill in many existing laboratories would not be well contained and thus damage delicate instruments. Furthermore, earthquakes and other vibrations may cause computers or other equipment to fall off shelves. Accordingly, a need has arisen for a shelving system which provides structural integrity and protection for computers and other delicate instruments against various threats of damage.

Use of computers and other equipment has also increased the need for services such as electrical wiring, networking and data/voice transmission and the distribution of physical items such as air, water, propane, hydrogen, nitrogen or a vacuum. However, it is desirable that such services be distributed in the room in a manner which avoids interfering with the work being performed, and that the services be protected against damage. Furthermore, it is desirable for services to be installed without having to rip up floors and make holes in walls and ceilings. Still further, it is desirable that any electricity or other services be distributed safely and in conformance with UL or other safety approvals.

However, wiring and other service lines in many laboratory and non-laboratory environments are typically exposed along a ceiling, wall or post thereby rendering them susceptible to damage. Other times, such service lines may be strewn about the floor behind cabinets or in a walkway where someone can trip over them thereby risking injury, breaking equipment or disrupting delicate research. And while certain existing systems attempt to cover or hide electrical wiring and the like, such covers typically serve only aesthetic purposes and do not provide real protection.

Worse yet, incompatible services such as electricity and water may be distributed adjacent to each other without adequate safeguards thereby risking electrical shorts or other accidents. And in current situations, floors, walls and ceilings must often be altered or otherwise disrupted to install the services in the first place. Accordingly, a need has also arisen for a shelving system which efficiently provides electricity, networking, data/voice transmission and various other services without the risk of injury, damage or disruption to the surrounding walls or other part of a building.

Current laboratories, warehouses and other locations with shelving must often be reconfigured to address different applications such as new types of research projects or different storage requirements. This typically requires that shelving and cabinetry in the laboratory be moved, supplemented, removed, or otherwise altered. However, existing shelving systems and cabinets have typically been fixed to floors, walls or ceilings thereby preventing easy reconfiguration to accommodate new applications. Furthermore, cabinets and shelves attached to such shelving systems are typically fixedly attached thereto and must thus be torn out to be moved. While various modular office partition systems exist, these are typically designed to provide individual workspaces in an office setting and not suitable for laboratory or other such uses.

Accordingly, a need has arisen for shelving systems which are modular and which may be easily installed, removed or reconfigured to accommodate changing laboratory or other requirements. This need also extends to the situation where the shelving system is intended to be removable where, for example, a laboratory or storage room is intended to be temporary.

Existing shelves typically comprise wood, plastic laminate or some other material. These shelving materials typically do not resist chemical spills, nor are easily formed into shapes suitable for containing spilled liquids or for containing instruments resting of the shelf. These shelf materials also have limited strength and thus limit the maximum span of a given shelf. Consequently, as users require more shelf space, they typically cannot use wider shelves, but instead must add more framework and supports which adds material cost, adds installation time and cost, and reduces flexibility. These existing shelves also typically require screws or other invasive fastening means to secure the shelf to the shelving systems or wall. This again increases cost and installation time, and hinders reconfiguration.

Accordingly, there is also a need for spill-resistant shelves of greater strength, which do not require screws or other types of permanent or invasive fasteners. A need also exists for shelves which can be designed and easily manufactured to contain spilled liquids or to contain instruments resting thereon.

Problems also exist regarding the strength and adaptability of current framework and other support structures. That is, they are generally not sufficiently strong in and of themselves to support the shelves and loads carried thereby. Accordingly, existing framework must typically be attached to walls or some other foundational structure to provide appropriate strength. This may create problems where, for example, the walls of the building transmit vibrations to the shelving system which may disrupt delicate experiments occurring thereon.

This lack of strength is especially problematic where shelving is necessary to form an"island" in the middle of a laboratory, warehouse or other location or when a whole self-standing or self-contained room must be constructed. For example, a self-standing food processing room may need to be constructed near the center of a large food warehouse. Here, it is desirable that the shelving system include framework that can provide the necessary strength to support shelves as well as the walls and ceiling of the self-contained room. While various self-standing modular office partition systems exist, these again are aimed at office settings and are not suitable for laboratories or other similar applications. Thus a need has also arisen for self-supporting and more versatile framework for shelving systems.

Also with respect to current frameworks, they typically may not be easily reconfigured, and are usually attached to some foundational support with many invasive fasteners. Among other issues, such fastening requires increased removal and installation time if the shelving system is to be reconfigured. Thus a need has arisen for shelving framework that may be used for different applications and configurations. A need has also arisen for framework that may be erected with a reduced number of attachments to a wall or other foundational support.

Problems may also arise in maintaining the cleaness of laboratories, food processing rooms and other "clean" environments due to small or hidden holes, crevices, ledges, openings or other physical features of the shelving system where bacteria may grow or other contamination may occur. Furthermore, in current framework systems, services such as electrical wiring are typically not well protected against high-pressure water or steam cleaning and other similar cleaning operations. Thus a need has arisen for a shelving system which reduces or avoids such physical features to facilitate maintenance of cleanliness standards, and which adequately protects services.

Beyond the foregoing problems and issues described above, current shelving systems and components thereof have other shortcomings. Accordingly, described below are improved shelving systems and associated components which addresses these problems and shortcomings.

III. SUMMARY OF THE INVENTION

In a first aspect of the invention, a shelving system which meets the diverse needs for today's laboratories and other types of rooms is described. That is, today's laboratories, warehouses and the like oftentimes require data transmission capabilities, the ability to safely support computers and other delicate instruments, as well as the ability to potentially house vast rows of shelves. Thus an aspect of the current invention addresses the fact that today's laboratories involve much more than performing chemical experiments and other uses typically associated with classic laboratories.

In another aspect of the invention, a shelving system is described including a framework which exhibits increased structural strength, adaptability to various configurations and to which is capable of housing and distributing electrical, communication and other services.

In another aspect of the invention, the framework provides support for shelves and loads thereon irrespective of being attached to walls, ceilings or other foundational supports, and may also be easily disassembled and reassembled to provide modularity.

In another aspect of the invention, shelves are described which comprise epoxy or some other material which are spill-resistant, which may contain spills and equipment, which have increased strength to allow longer shelf span, which are susceptible to molding in a variety of shapes and sizes, and which may interlock with the framework.

In another aspect of the invention, a shelving system is described which avoids openings or other physical features which may lead to contamination of a clean environment and which helps the user maintain cleanliness.

These and other aspect of the invention are now described in more detail below.

IV. BRIEF DESCRIPTION OF THE DRAWINGS

FIG. 1 is an overall view of a shelving system mounted to a wall.

FIG. 1*a* is an exploded assembly view of a portion of a shelving system.

Figures 9A, 9B, 10A, 10B:
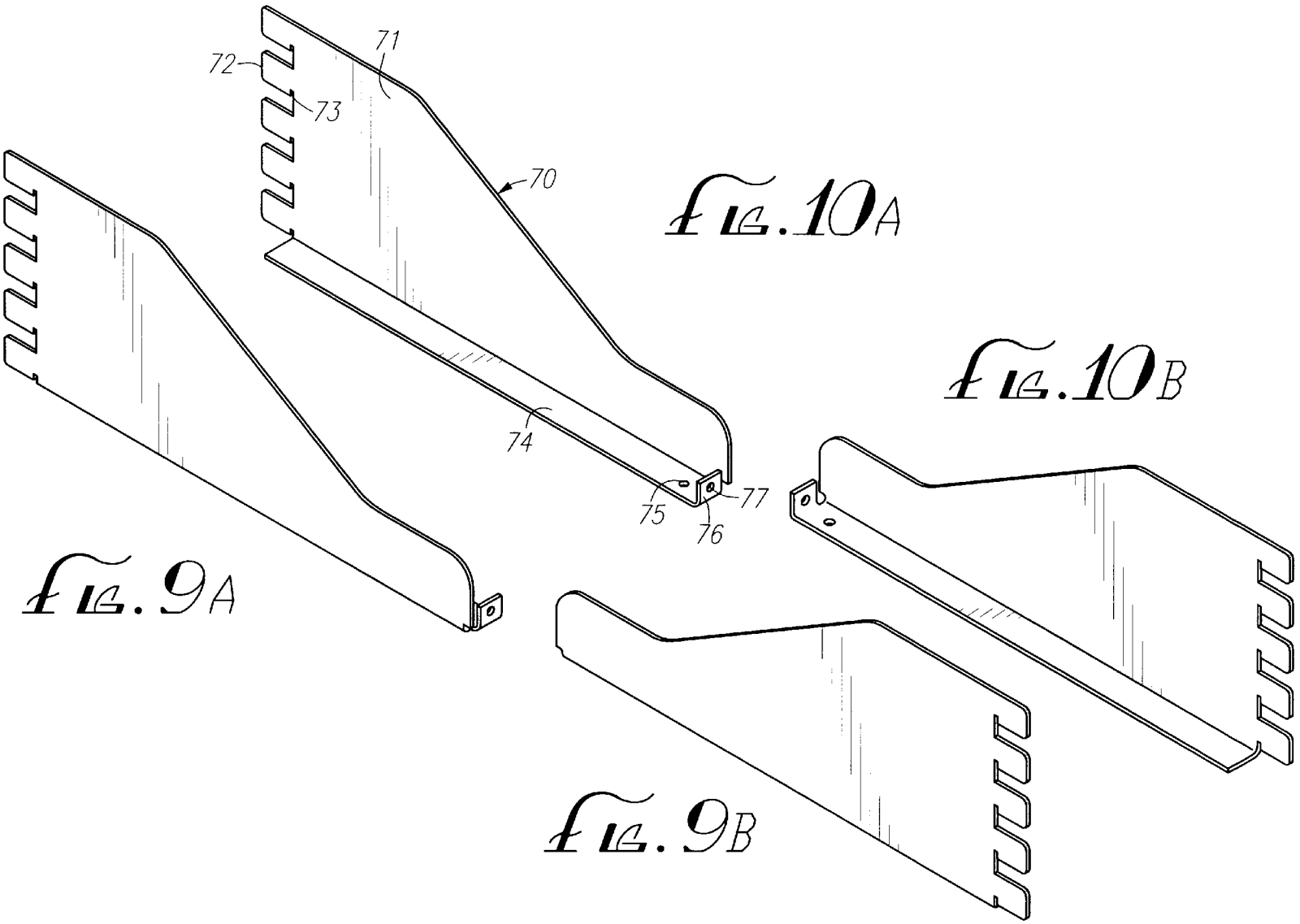

FIGS. 9*a,b* show brackets providing support from below and with lips on the right.

FIGS. 10*a,b* show brackets providing support from below and with lips on the left.

Figures 11A, 11B, 12A, 12B:
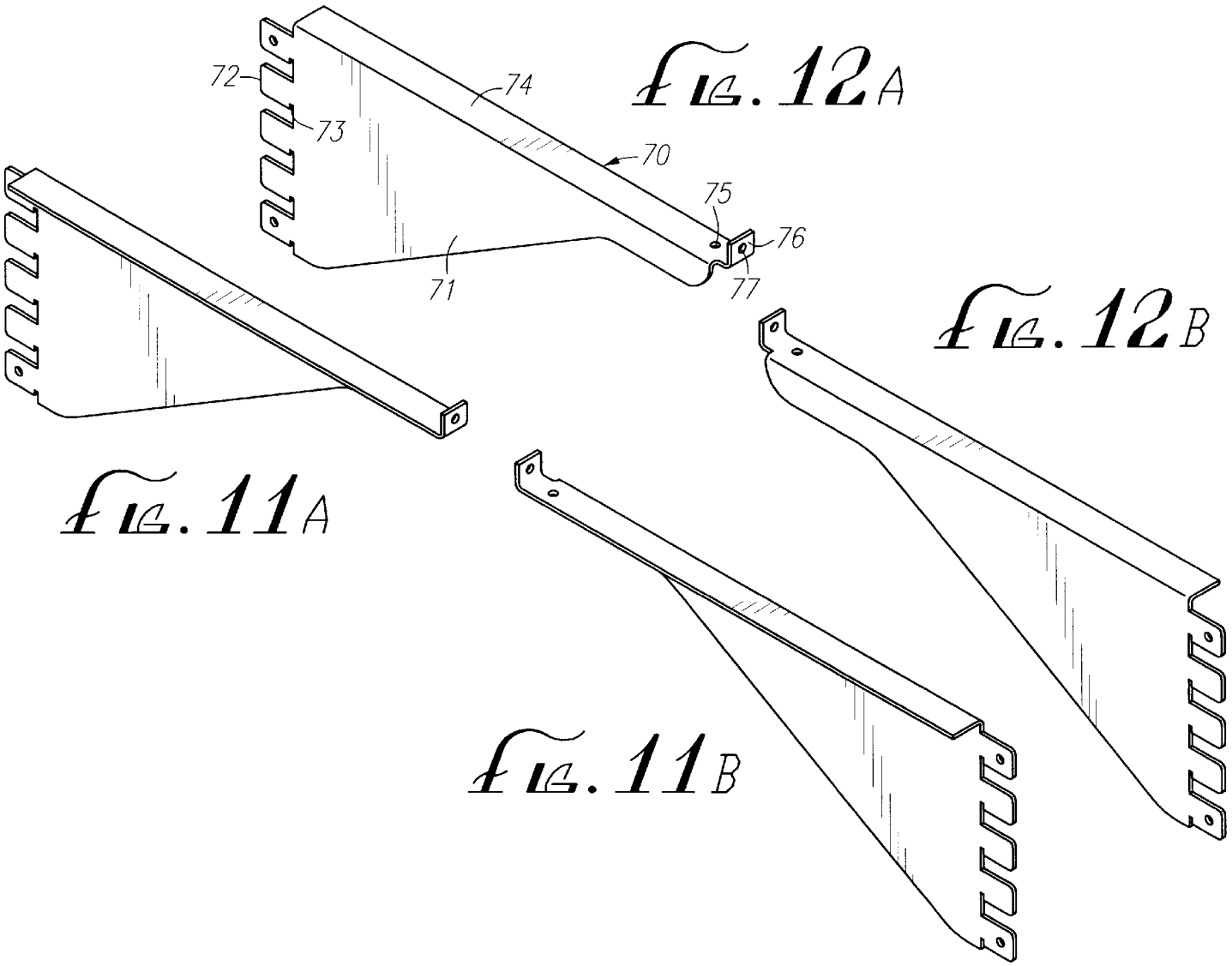

FIGS. 11*a,b* show brackets providing support from above and with lips on the left.

FIGS. 12*a,b* show brackets providing support from above and with lips on the right.

Figure 13:
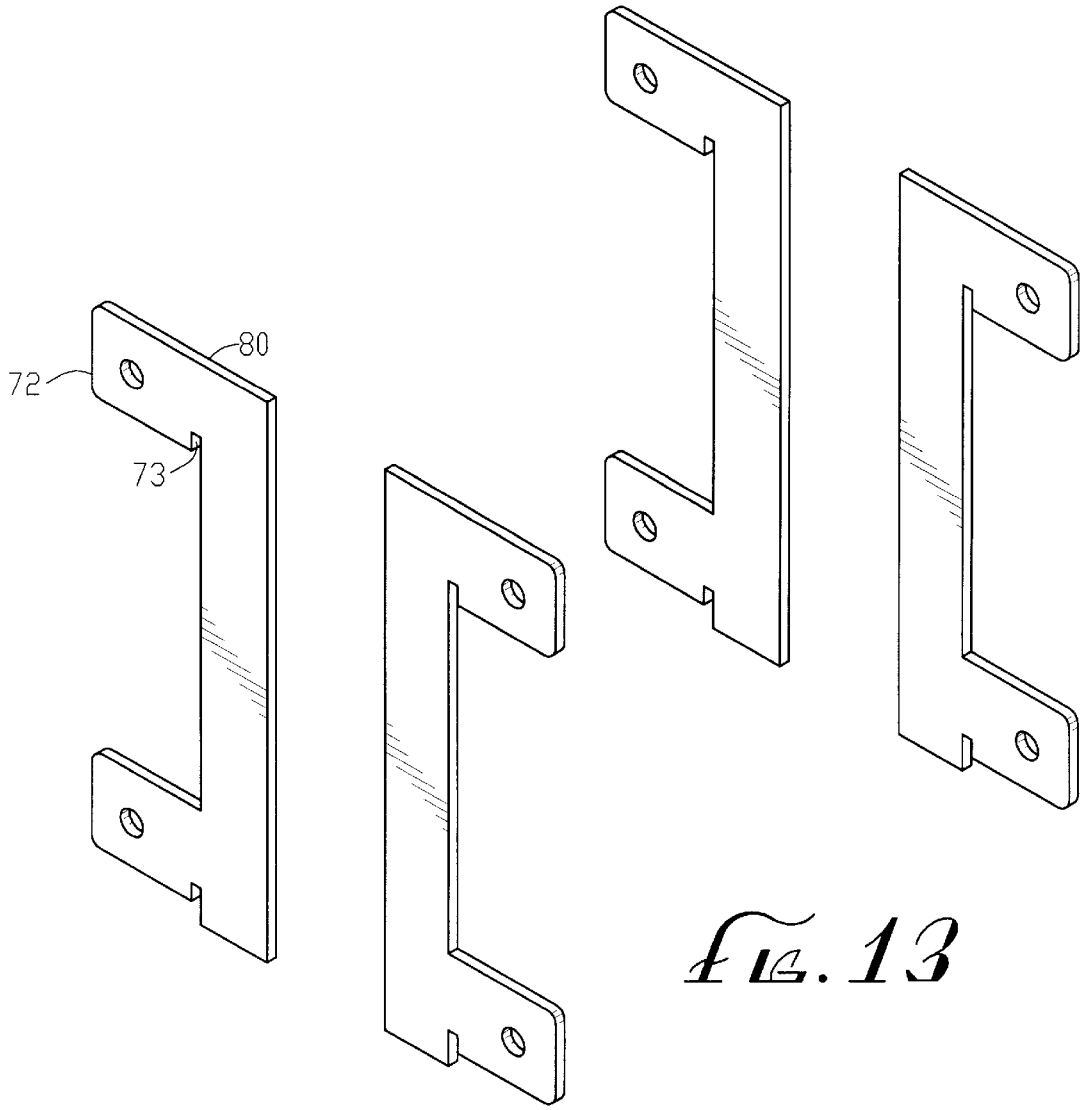

FIG. 13 is a perspective view of a bracket filler.

Figure 14:
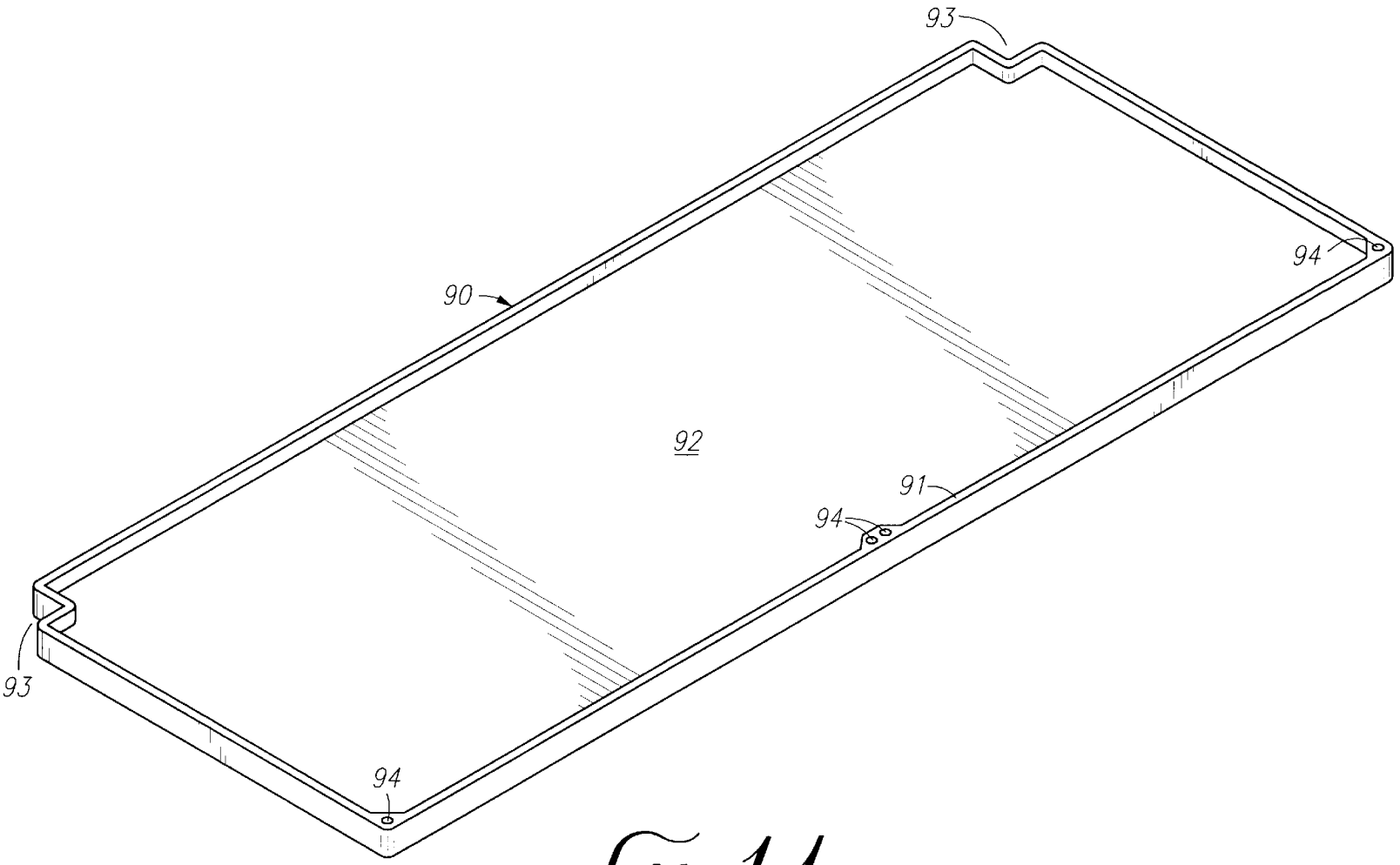

FIG. 14 is a perspective view of a spill-retaining shelf.

Figure 15:
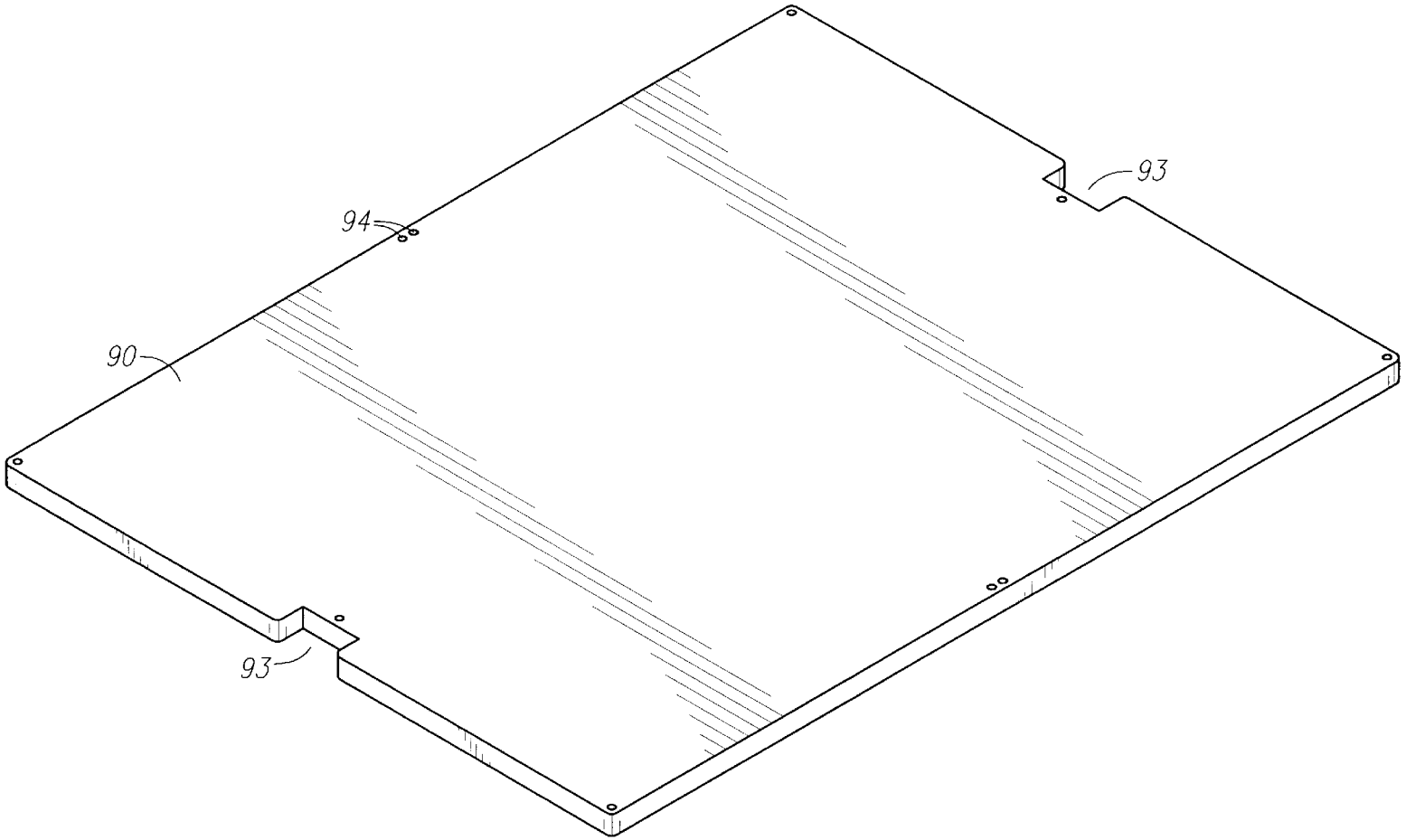

FIG. 15 is a perspective view of an alternate shelf.

Figure 16:
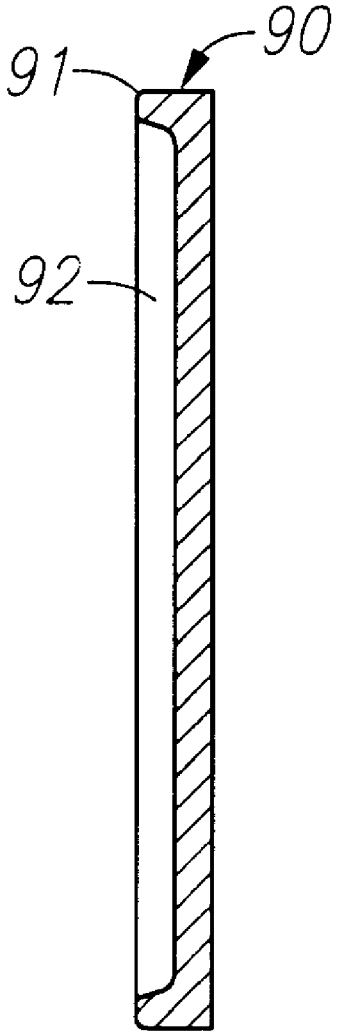

FIG. 16 is a side section view of a shelf.

Figure 17:
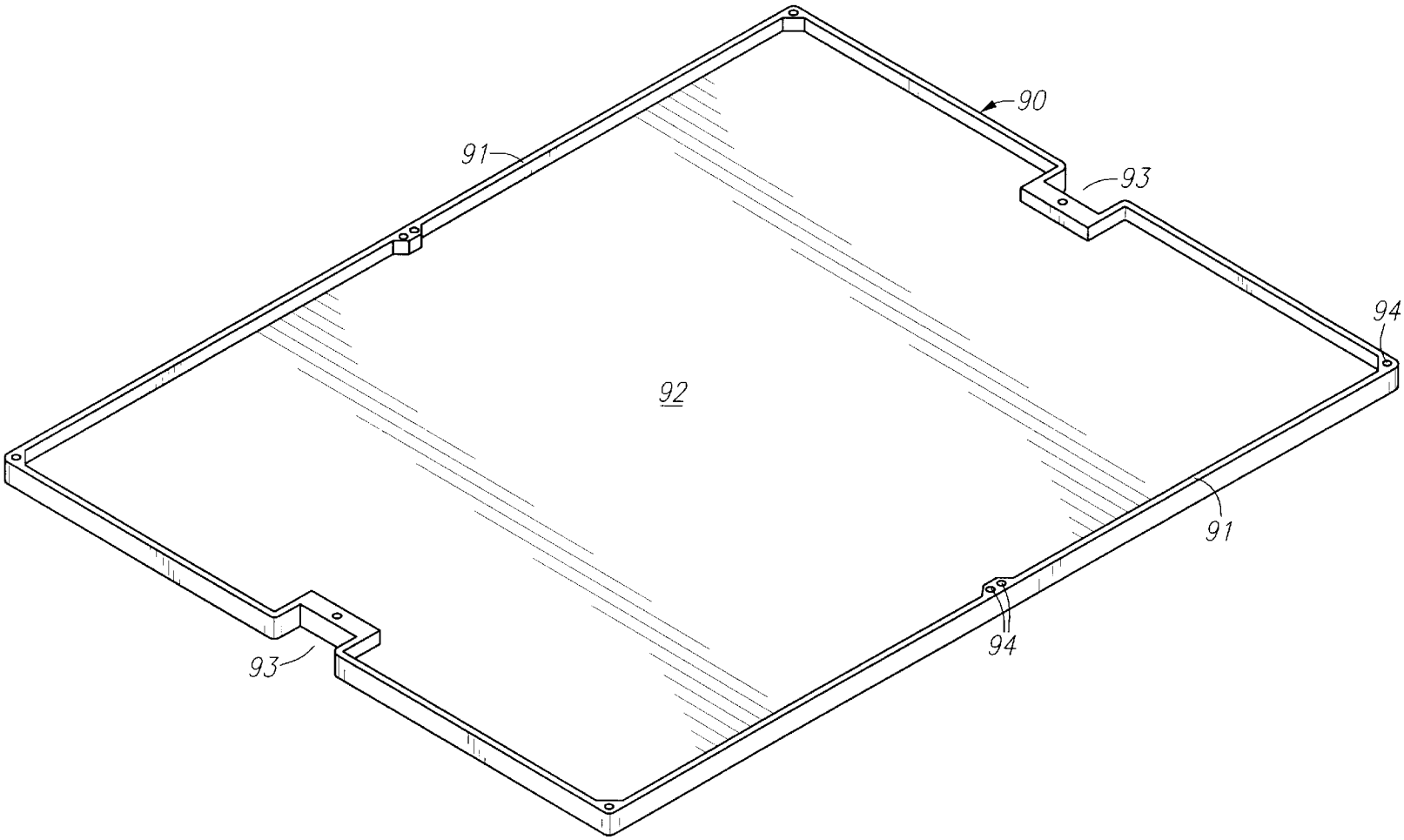

FIG. 17 is an alternate shelf.

FIGS. 18*a–d* show different views of a retaining clip assembly.

Figure 19:
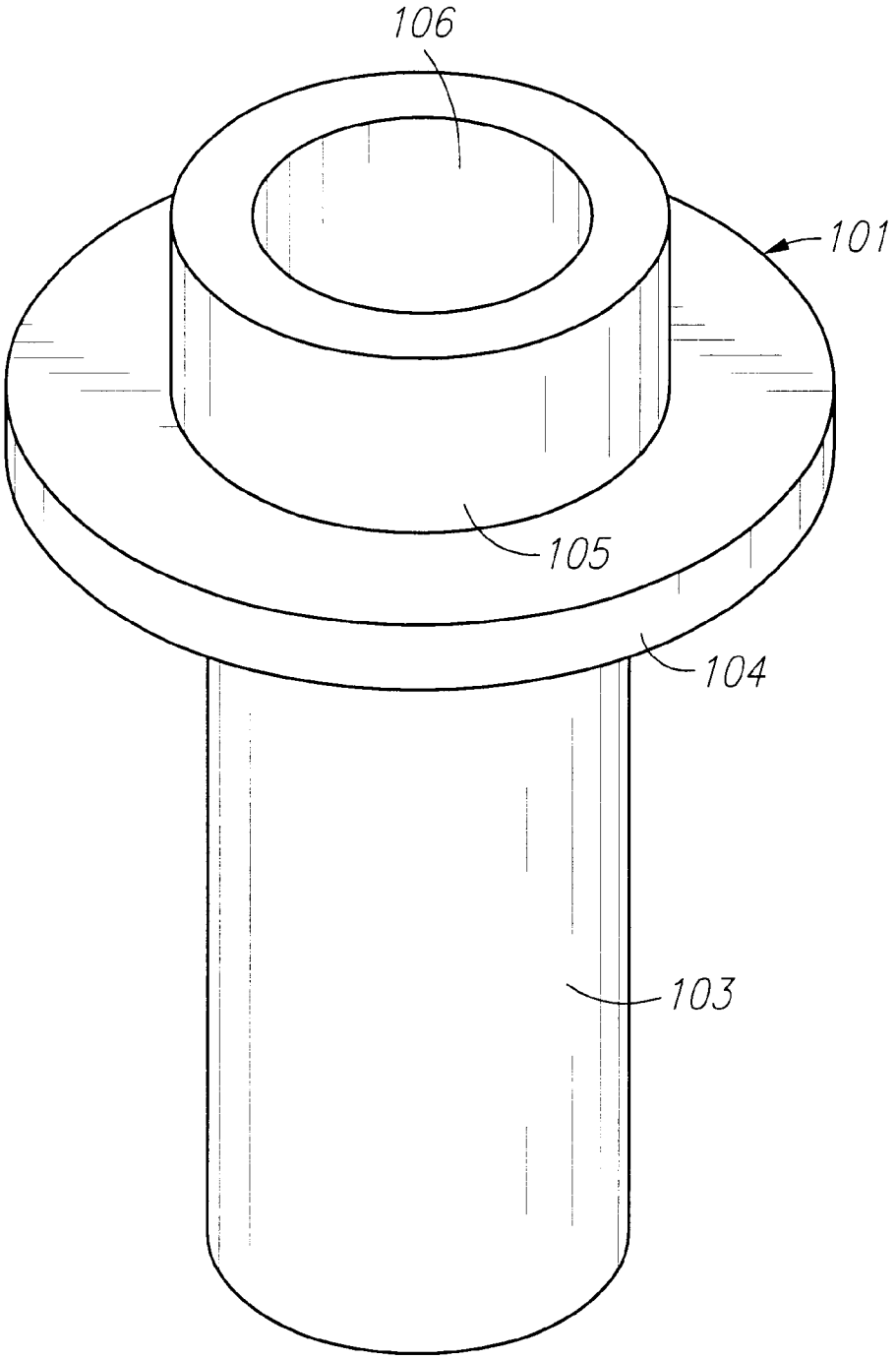

FIG. 19 shows a bushing insert.

Figure 20:
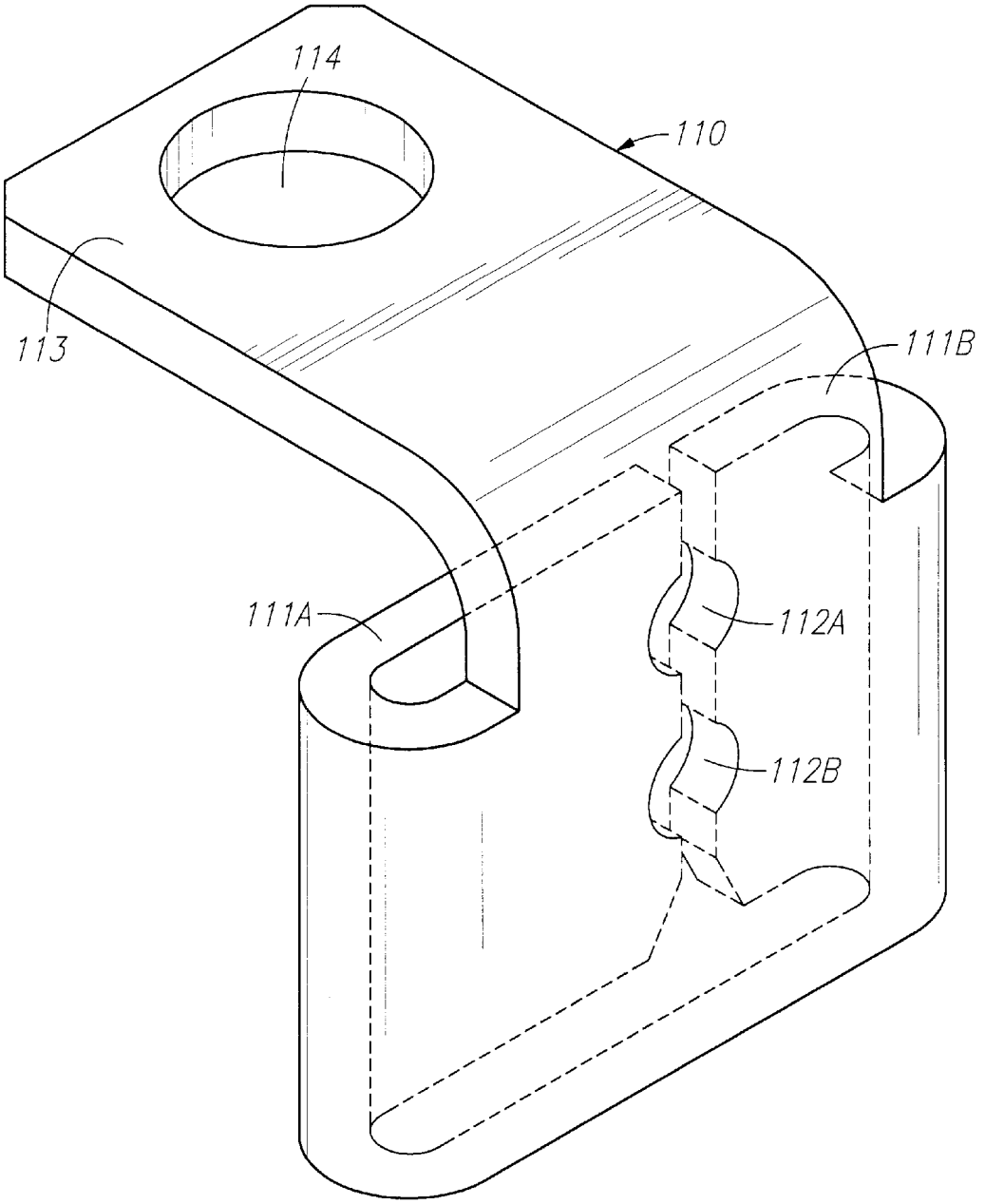

FIG. 20 shows a retaining clip.

V. DESCRIPTION OF THE PREFERRED EMBODIMENTS

Figure 1:
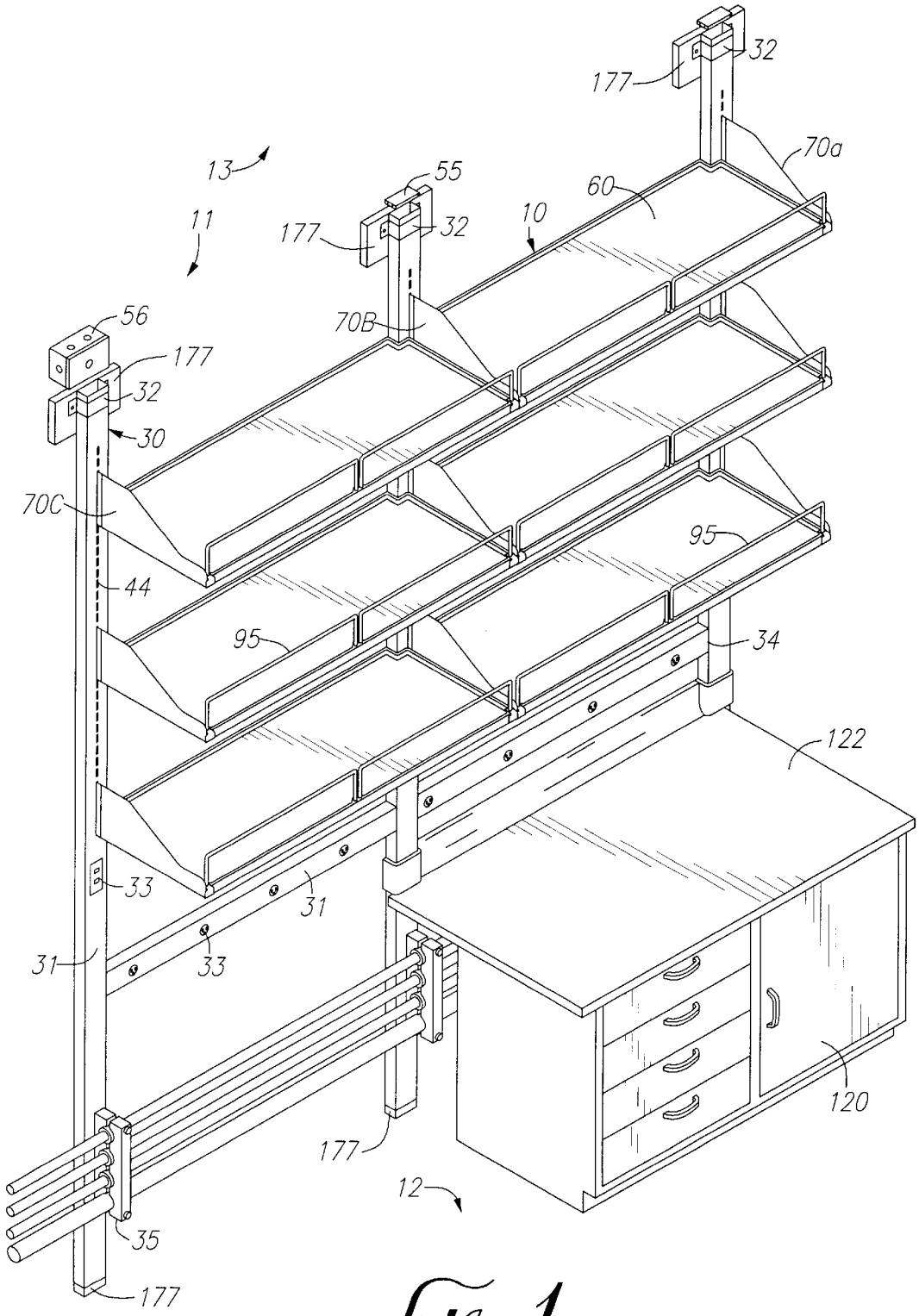
Figure 1A:
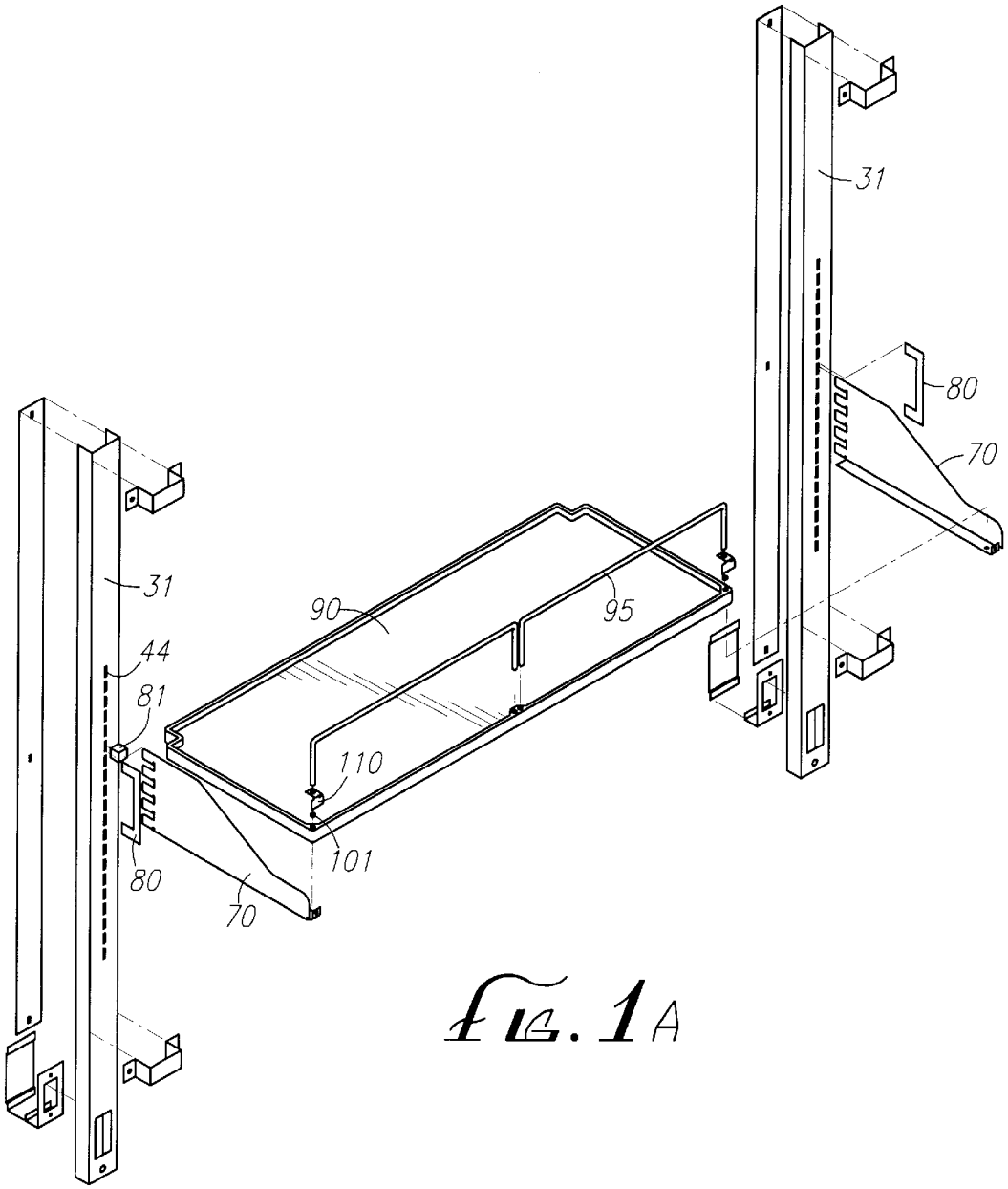

Referring to FIG. 1, shelving system 10 is generally shown in proximity to wall 11, floor 12 and ceiling 13. Shelving system 10 may include framework 30, brackets 70, shelves 90 and cabinetry 120. As discussed in more detail below, it is preferred that brackets 70 securely interlock with framework 20, and that shelves 90 securely interlock with brackets 70 without the need for invasive or permanent fasteners. FIG. 1*a* shows how the foregoing components may be removably assembled without using invasive fasteners.

Framework 30 may include one or more members 31 which generally provide structural support for the various shelves 90, cabinetry 120 or other hardware included in shelving system 10. As discussed below, members 31 may preferably house, support and distribute services such as electrical lines, vacuum, gases, liquids and data transmission. For example, members 31 may house the electrical line that is connected to electrical or other type of outlet 33. Thus, members 31 may advantageously perform the dual functions of structural support and services distribution.

Figure 2:
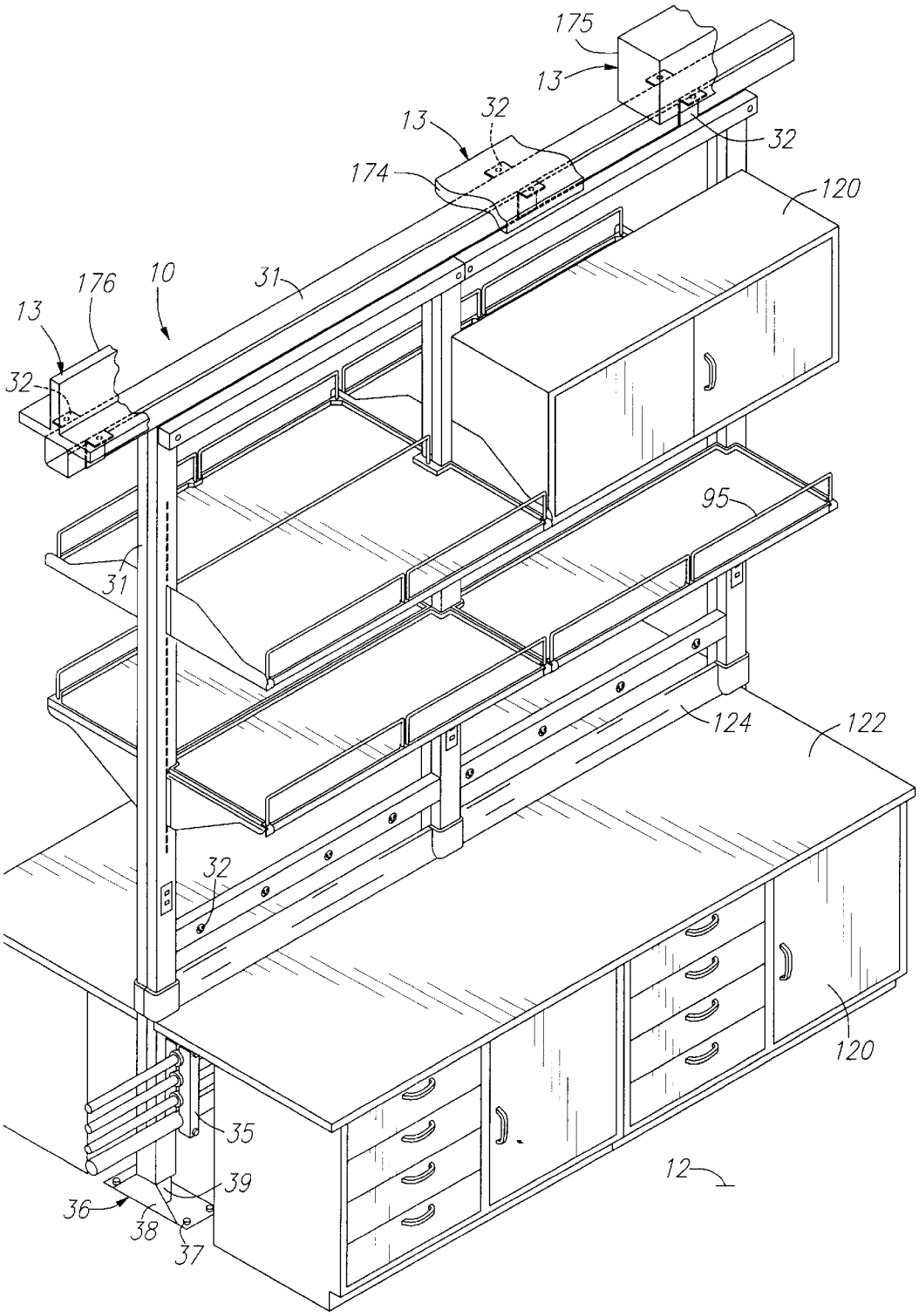
FIG. 2 is an overall view of an alternate shelving system in a self-standing configuration.

FIG. 2 shows an alternate shelving system 10 which is generally self-standing and may thus comprise an "island" in the middle of a room, or may constitute a self-standing room as described below. In this embodiment, members 31 need not necessarily be attached to walls 11 to still provide support for shelves 90 and any load thereon.

As shown in FIGS. 1 and 2, members 31 may comprise vertical columns 31 or horizontal beams 31, but diagonal or other configurations may be used. Furthermore, though FIGS. 1 and 2 show framework 30 with a certain number of columns 31 and beams 31, varying numbers of members 31 may be used. To this end, it is preferred that the number and configuration of members 31 be designed to support whatever load is contemplated on shelves 90. Where members 31 are not attached to a wall but instead may need to themselves support decorative fillers between members 31, or a wall, ceiling or other structure, it is also preferred that members 31 be configured to provide adequate strength therefor.

The materials which may comprise members 31 and their manufacture are now described. To help provide strength and resistance against corrosion and chemicals, members 31 generally comprises a housing 42 which is preferably constructed from epoxy-coated steel, stainless steel, fiberglass or other suitable material. An epoxy or other chemically resistant coating is preferred because it protects against corrosion or other damage from chemical spills and the like. Such a coating also prevents rusting.

Steel or some other rigid material is preferred for housing 42 so that members 31 need only be secured at a minimum of points while still providing sufficient structural integrity. This is in sharp contrast to many existing shelving systems wherein the framework must be connected to a wall or other foundational support at numerous locations to provide sufficient strength and rigidity.

Members 31 may be manufactured by roll forming. In this case, a thinner gauge material may be used because the roll-formed bends in the resulting member may provide sufficient rigidity and structural integrity. Alternatively, members 31 may comprise a heavier gauge material and may be formed by other manufacturing processes.

The current invention also contemplates that different types of members 31 may exist. For example, vertical columns 31 in FIGS. 1 and 2 may generally need to bear a significant portion of the load. Accordingly, such members may be constructed of a heavier gauge or otherwise stronger material, or are larger in girth.

On the other hand, depending on the strength requirements of shelving system 10, horizontal beams 31 may not need to bear much of the load. Instead, horizontal beams 31 may primarily provide a services distribution function. Accordingly, beams 31 may be constructed of a thinner gauge material or may be smaller thereby saving cost. It should be noted however, that horizontal beams 31 may very well need to display increased strength and may thus comprise a heavier gauge or stronger material.

Furthermore, certain members 31 may act as main arteries for services distribution and may thus be larger sized. As the services branch off to other members 31, these other members 31 may be smaller because they need not carry as many services. However, the size of these other members 31 may also depend on structural requirements.

Members 31 may be designed to handle both compression, tensile, rotational or other forces. Alternatively, where it is known that members 31 need only be capable of handling certain of these forces, they may be designed accordingly to save on cost. In any event, it is contemplated in the current invention that framework 30 comprise members of varying configuration to provide flexibility depending on the structural and services requirements of the laboratory or other room.

Figure 3:
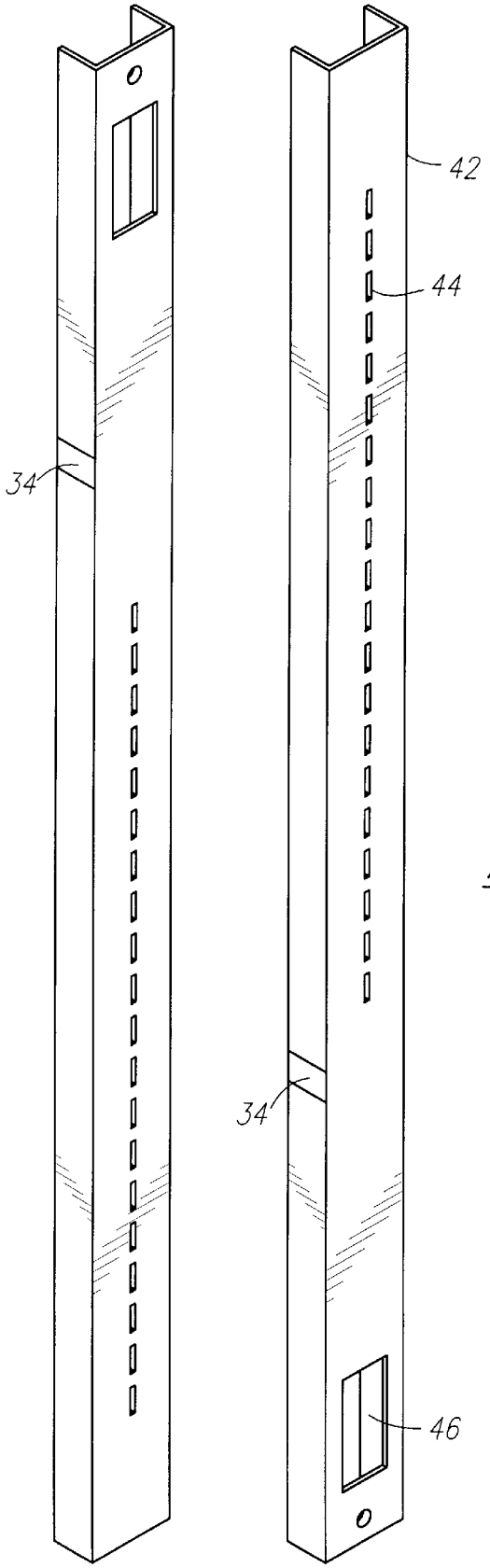
FIG. 3 is a perspective view of a member housing.

Members 31 may engage each other as follows. As shown in FIGS. 1, 2 and 3, either vertical column 31 or horizontal beam 31 may include knock-out portion 34 formed by a perforation or the like in the members sides. Thus where one member 31 is to perpendicularly or otherwise cross another, knock-out portion 34 on the one member 31 may be easily removed, preferably by hand or light tool, so that the perpendicular member 31 may pass through. In this manner, the surfaces of vertical and horizontal members 31 remain substantially flush with one another thereby avoiding protrusions which could interfere with laboratory work or placement of objects on shelves 90.

Brackets or other attachment devices (not shown) may be used to secure horizontal and vertical members 31 to each other thereby adding strength and rigidity to the overall framework 30. Brackets may be mounted by screws or other fasteners within member 31 or externally. It is preferred that screws or other attachment means are used in a manner which does not disrupt the services extending through members 31. Alternatively, adjacent members 31 may be bolted or welded together. In any event, when the various members 31 are attached, they form a grid or skeleton comprising framework 30.

As an example, members 31 may be arranged and attached as follows. Horizontal members 31 may be attached to vertical member 31 below countertop 122, at countertop 122, just above countertop 122 and/or at the top of vertical members 31. This arrangement helps align vertical member 31 during installation, develops structural integrity of framework 30 independent of any attachment to wall, floors or ceilings. And because it is preferred that member 31 are adapted to distribute services, this arrangement also provides a matrix for services distribution to various locations in the laboratory or other room. Horizontal member 31 may also provide structural support for other components as discussed below such as lighting fixtures.

The horizontal member 31 attached below countertop 122 ensures the desired spacing between vertical members 31, and also provides a services distribution link between successive vertical members 31. Utilities and other services may also be mounted external to the sub-countertop horizontal member 31 as shown in FIGS. 1 and 2 so that such services do not interfere with the workspace on countertop 122.

The horizontal member 31 attached at the level of countertop 122 also ensures desired spacing between vertical members 31 and may also provide another services distribution link. This horizontal member 31 may also provide support to backsplash 124 which is discussed later.

The horizontal member 31 attached above countertop 31 again ensures proper vertical member 31 spacing and may also provide a services distribution link. Furthermore, the horizontal members 31 at this level may be fitted with outlets or connectors 33 which are shown in FIGS. 1 and 2, and which are coupled to service lines running through member 31. Thus personnel may easily plug into the desired services. Such services may include electricity, network (data, voice and video), communication, gas (nitrogen, argon, propane etc.), liquid (water, RO water, deionized water, etc.) and vacuum.

The horizontal member 31 attached at or near the top of vertical members 31 i.e., over head member 31, as shown in FIG. 2, completes the process of ensuring that vertical members are aligned at the desired spacing. Such top-mounted horizontal members 31 may also extend between vertical members 31 perpendicularly to the horizontal member of FIG. 2, thereby adding structural integrity to the overall framework 30. These top-mounted member 31 may provide a services distribution link, and may also support ceilings, HEPA filters, lights, cabinets etc.

General configurations for framework 30, and its attachment to foundational structures are now more fully described. A first configuration is that shown in FIG. 1 where members 31 may be secured to wall 11 by mounts 32. In this arrangement, mount 32 may wrap around member 31 and may be attached to wall 11 via screws through the holes shown. However, attachment means other than screws may be used. In any event, the increased strength of members 31 and framework 30 provide that fewer attachments to wall 11 are necessary than in current systems. For example, vertical member 31 may preferably be attached to wall 11 at only its top and bottom which minimizes the number of invasions in to the surrounding building. This is in sharp contrast to many existing vertical supports that need numerous wall connections.

Members 31 may be mounted to floor 12 and ceiling 13 by similar mounts. Alternatively a pressure-fit arrangement may be used whereby the top and/or bottom of vertical members 31 may include adjustable pods (not shown) which threadably engage member 31 and which may be extended from the top and bottom. In this embodiment, member 31 may be fitted between floor 12 and ceiling 13, and then the pods may be adjusted so that they extend from the top and/or bottom of member 31 and engage floor 12 and/or ceiling 13 until a snug fit is ensured. Such an arrangement also reduces the number of invasions to the building.

This adjustment embodiment also provides a leveling function whereby the height of vertical columns 31 may be changed to level the shelves 90 which are ultimately supported thereby. This is desirable because oftentimes, the floor in an existing building is not level.

By reducing the number of attachment points and intrusion into the building itself as described above, shelving system 10 may be more easily installed, reconfigured and removed from the building. When shelving system 10 is removed, this avoids leaving an excessive array of holes or other disruptions to walls, ceilings and floors. This modularity capability is advantageous because in current times, temporary laboratories and other types of rooms are often erected. And regarding installation, decreasing the number of wall attachment points is significant because oftentimes, an inadequate number of wall studs exist. Other times, wall studs may not be correspondingly located at desired member 31 positions. These problems are thus overcome.

Modularity also provides benefits from a practical business point of view. With the current invention, a building owner is not committed to buying shelving system 10 because it need not become a permanent part of the building. Likewise, the owner or user of any such temporary laboratory or room may easily install and then remove shelving system 10 from the building. Shelving system 10 may thus be treated similar to other removable equipment for financing purposes and the like.

It should be noted that the modularity provided by the current invention has not been possible with current framework and shelving systems. While modular office partitioning systems do exist, these are typically designed to provide personalized work spaces and privacy in the office. They do not accommodate the rigors that are often associated with experiments, storage, testing and other laboratory-type applications.

As mentioned above, FIG. 2 shows an alternate framework configuration where framework 30 may stand alone without attachment to wall 11. In such configurations, framework 30 may constitute an "island" of shelves 90, cabinetry 120 and countertops 122 in the middle of a laboratory. Alternatively, framework 30 may constitute an independent modular building structure in and of itself which may be located within a larger building such as a warehouse, or which may be located outside as a separate building. In this arrangement, framework 30 may include adjacent walls comprising horizontal and vertical members 31, and one or more overhead members 31 attached at the tops of such walls thereby completing a framework 30 that provides the skeleton for the self-standing room.

In either the island or self-standing building embodiments, vertical members 31 may be mounted to floor 12 by using the cantilever base 36 depicted in FIG. 2. Attachment by cantilever 36 is advantageous because it minimizes the intrusion into the building itself by minimizing the number of attachments to floor 12, and by avoiding the need for wall-anchoring. This also eases installation and removal and thus provides modularity. If desired, certain horizontal members 31 may also be mounted to floor 12.

As shown, base 36 may be anchored to floor 12 by anchoring bolts 37 or some other type of fastener. Base 36 preferably includes upright flange 38 and post 39 for securing vertical column 31. After base 36 has been anchored to floor 12, member 31 may be mounted thereon whereby post 39 snugly fits within member 31 and flange 38 is adjacent to the outside of member 31. Member 31 may then be bolted or otherwise attached to post 39 and/or flange 38.

To provide a leveling function, it is preferred that member 31, flange 38 and/or post 39 include a plurality of vertically-extending holes. This allows member 31 to be positioned on base 36 at various heights relative to floor 12 to cancel out the waviness which exists in many floors, and to thus ensure that shelves 90 are level. Vertical member 31 is thus securely anchored to the floor and, may remain upright despite supporting a load. Depending on the loading requirements of island system 10, more, fewer or all vertical members 31 may be so anchored.

Alternatively, if vertical columns are arranged in a square-like or other configuration where lateral support is provided by interconnecting horizontal beams 31, e.g., such as top-mounted member 31 in FIG. 2 and other top-mounted members 31 aligned perpendicularly thereto, cantilever base 36 may be unnecessary. Instead, a lighter duty base that need only prevent framework 30 from moving, but need not provide a cantilever function, may be used.

Framework 30 may also comprise a self-standing grid for a room or other structure. To this end, various ceiling trusses and other members may be included to ensure adequate strength, rigidity, and services distribution. After framework 30 has been thus erected, a grid or skeleton for completing the stand alone structure exists. Thus, decorative filler tiles, wall and/or ceiling panels, lighting panels, HVAC or other ducting or any other elements required for a functioning room(s) may be mounted thereon.

Brackets 70, shelves 90 and cabinetry 120 may also be added thereon. Here again, cantilever base 36 may not be necessary because lateral support for each vertical member 31 is inherent in the self-standing grid. It is also possible that no type of floor base is necessary because the weight of the self-standing grid serves to keep it in place.

Advantageously, members 31 may rely primarily on themselves for any necessary strength without support from wall 11, thereby making the island and self-standing building embodiments possible. This is in sharp contrast to existing stanchions or other framework which must typically rely on the wall, ceiling or other foundational support for strength purposes.

Another configuration for framework 30 refers to the situation where tall vertical columns 31 are included in the island shown in FIG. 2. Here, columns 31 may simply be too tall, and/or may need to support heavy loads such that adequate lateral support cannot be provided by cantilever base 36 alone. Accordingly, the tops or upper portion of columns 31 may be attached to ceiling beams 175 or other structures such as the T-bar 176 structure present in many factory ceilings. The attachment may occur through cables or other brackets such as mount 32. Here again, cantilever base 36 may thus be replaced with a lighter-duty floor anchoring device.

Sufficient structural integrity is thus achieved even where vertical columns 31 are relatively long. This is so because the increased strength of vertical members 31 resists bending moments due to their structure as described below, and also because the network of attached vertical and horizontal members 31 add rigidity. It should be noted that the strength and adaptability of member 31 allows that they be used in any of the foregoing framework configurations, as well as other configurations.

Anti-shock and anti-vibration capabilities of framework 30 are now described. To help protect delicate instruments or experiments located on shelves 90, padding, cushions or some other type of vibration dampening material 177 may be strategically located throughout framework 30. This padding or cushion material 177 may be shaped as thin strips, thick, thin, square, circular or whatever shape and size is necessary to adequately interject between two surfaces. This helps isolate framework 30 from any vibrations that may be transmitted from the surrounding building walls or floors. The anti-vibration material may comprise rubber, urethane, high-density urethane, hollow cushions, air support devices or other materials or mechanisms.

For framework 30 of FIG. 1, it is preferred that anti-vibration material be positioned where members 31 are attached to wall 11. Anti-vibration material may also be placed at any point where members 31 are attached to floor 12 or ceiling 13. For example, the leveling devices of members 31 may include anti-vibration material. Furthermore, anti-vibration material may be positioned between the joints of certain members 31 such as critical locations, e.g., the corner of a self-standing framework 30, or at various intervals. Alternatively, anti-vibration material may be positioned at all joints between members 31. For example, padding may be placed at the location of a knock-out section 34 where horizontal and vertical members 31 are attached.

Isolating building vibration from framework 30 in turn isolates vibration from shelves 90. Consequently, delicate instruments and experiments may be located on shelves 90. This represents a distinct advantage over current situations where costly and bulky anti-vibration tables or the like are required. Vibration isolation also aids in compliance with earthquake regulations.

The foregoing anti-vibration aspect of the current invention represents a distinct advantage over existing shelving systems that locate pieces of foam or the like at certain locations. That is, the current invention provides a comprehensive anti-vibration scheme by locating padding or the like at many or all locations where framework 30 is coupled to a building thereby dampening vibrations coming from the building or ground. Furthermore, padding or the like is placed throughout system 10 to dampen vibrations created within the system 10. This is in sharp contrast to existing systems which, e.g., place foam between a shelf and bracket. While this current arrangement may provide some isolated shock-absorbing capability, it does not account for vibrations received by walls or the ground.

Figure 4:
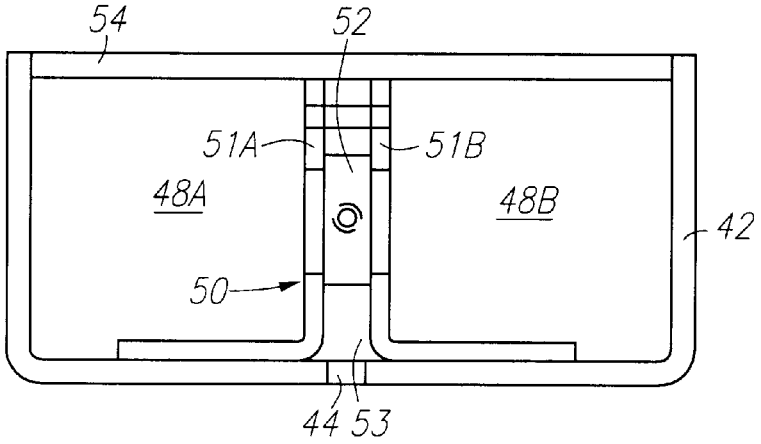
FIG. 4 is a top view of a member.
Figure 5:
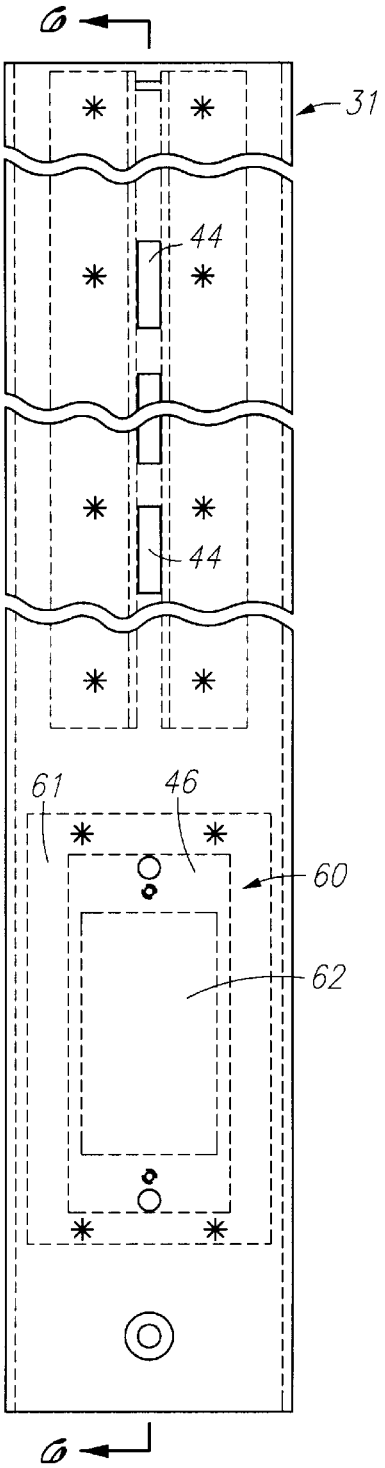
FIG. 5 is a front view of a member.

Referring now to FIGS. 3–5, the structure and internal configuration of members 31 are now more fully described. FIG. 3 shows housing 42 which may comprise the external portion of member 31. Slots 44 preferably extend axially along housing 42 or at locations where brackets 70 and shelves 90 are intended to be located. Slots 44 may accommodate brackets 70 and bracket fillers 80 as discussed below. Housing 42 also preferably includes knockout portions 34, and whatever cut-outs or holes that are necessary for the entrance and exit of services as discussed below. Knock-outs 34, cut-outs and holes may be located at any desired location along housing 42.

Successive shelves 90 may thus be positioned at a variety of heights and locations to accommodate persons of varying height, instrumentation or other objects of varying size and any other configuration parameters required of shelving system 10. As discussed later, housing 42 may also include hole 46 which may be used to provide an electrical outlet, or an entrance or exit part for some other type of service.

Referring now to FIG. 4, it is shown that the interior of member 31 may be divided into two channels 48*a* and 48*b* by channel divider 50. In this preferred embodiment, divider 50 includes two oppositely-faced L-shaped flanges 51*a,b* which may comprise cold-rolled steel with or without epoxy or other coating. Divider 50 thus acts as an internal stiffening device and adds to the strength of member 31 especially because it extends in two directions and may thus resist bending moments along different axes. Other configurations for divider and stiffening device 50 may also be used.

Flanges 51*a,b* may be secured by captive nuts 52 which may be positioned at axial intervals along flanges 51. It is preferred that captive nuts 52 be positioned a distance from the front of member 31 so that the tabs 72 of brackets 70 or bracket fillers 80 may be inserted through slot 24 and into space 53 unhindered. Positioning nuts 52 a distance away from slots 44 also provides that space 53 constitutes a deep channel 53 for purposes of bracket 70 stability as discussed later.

For uniformity in strength and rigidity, flanges 51 and captive nuts 52 may be generally located along the center line of member 31. It should be noted that devices other than captive nuts 52 may be used to hold flanges 48*a,b* together and also provide deep channel 53. For example, a bar, rod or other part may be welded to flanges 48*a,b*.

Channel divider 50 may be pre-formed and then secured within member 31 at various locations by welding, fasteners or some other means. The configuration reflected by channel divider 50 is especially advantageous because it provides structural rigidity in the direction of bending moments created by shelves 90 and the objects resting thereon.

Divider 50, flanges 51*a,b* and housing 42 are all preferably sized so that channels 48*a,b* are large enough to contain and distribute services. And as discussed in more detail below, channels 48*a,b* are isolated from each other as well as from deep channel 53 thereby protecting the services that extend therethrough.

As discussed in more detail later, the tabs 72 of two brackets 70 are preferably inserted through each slot 44. Thus to provide lateral stability and an interlocking effect, the width of slot 44 and the distance between flanges 51 are preferably substantially equal to each other and are also preferably substantially equal to the combined width of two tabs 72. In this manner, once tabs 72 are inserted into space or deep channel 53, wagging or other lateral movement of brackets 70 is reduced or eliminated. To this end, the depth of deep channel 53 preferably allows a significant portion of tabs 72 to protrude into member 31 which also prevent lateral wagging.

Figure 6:
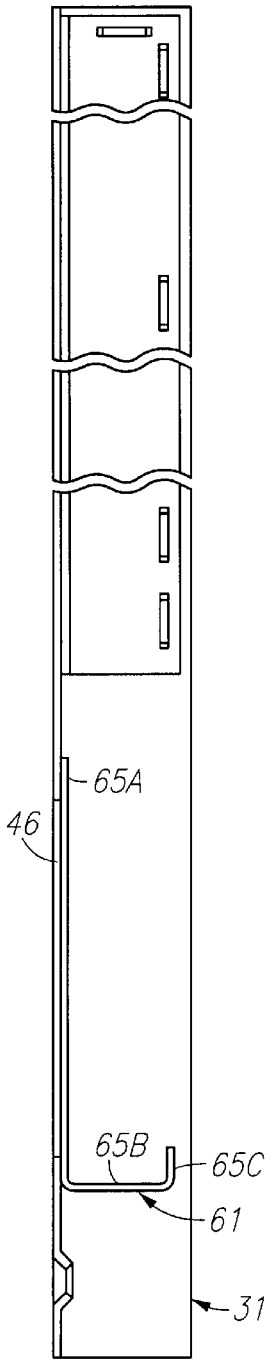
FIG. 6 is a side view of a member with an electrical connector bracket.
Figure 7:
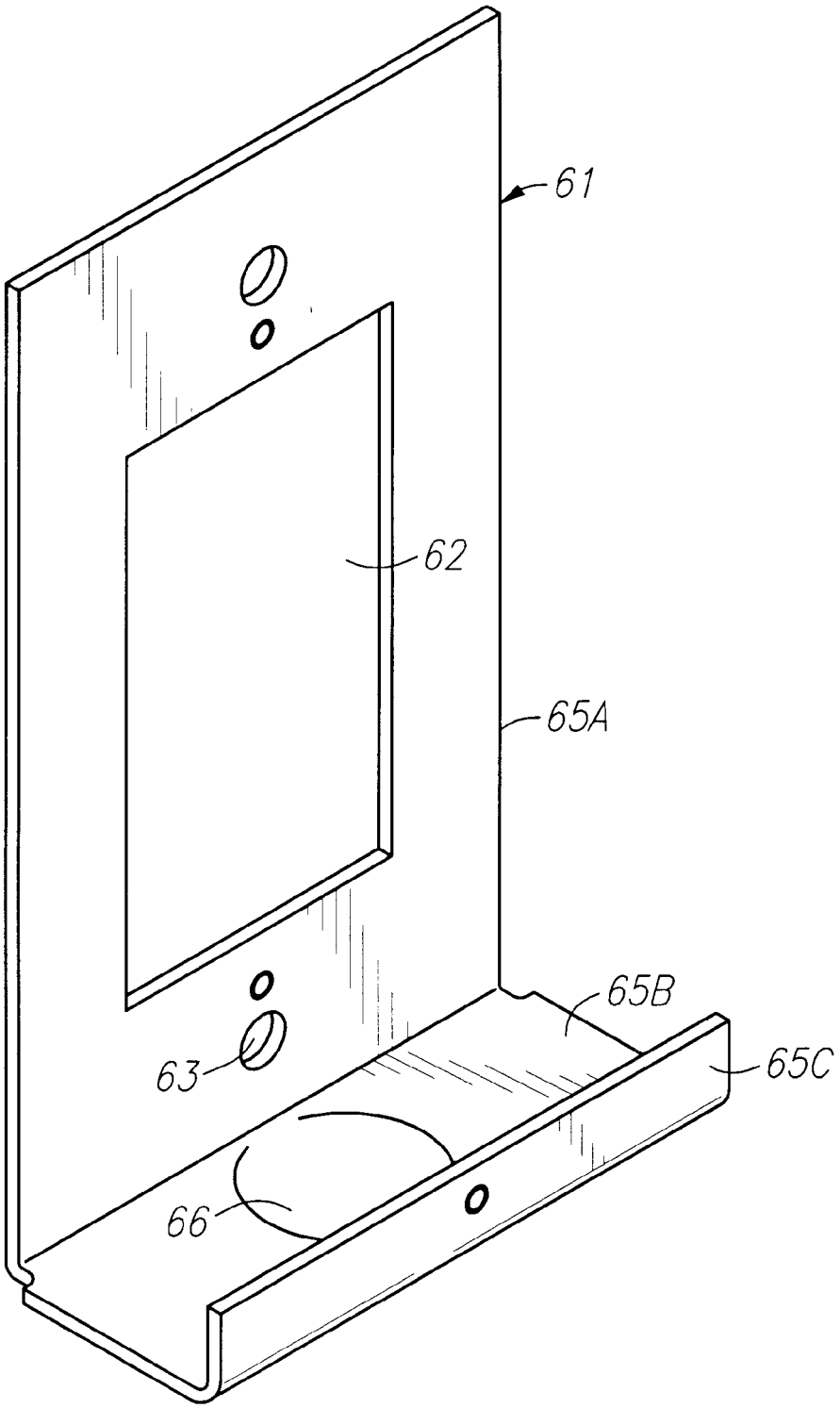
FIG. 7 is a perspective view of an electrical connector bracket.

Referring now to FIGS. 5–7, member 31 may house electrical outlet assembly 60. Assembly 60 may be secured to housing 42 by welding or some other suitable means at or near hole 46 or other location to provide electrical outlet 33. To this end, hole 46 may be located at a standard location on each member 31 so that the user may readily locate electrical outlets.

Electrical assembly 60 may include electrical J-bracket 61 as shown in FIG. 7. Bracket 61 includes hole 62 which preferably corresponds to hole 46 (shown in FIG. 5) cut out of housing 42. Bracket 61 also includes holes 63 for receiving screws that may couple electrical outlet 33 to bracket 61. Bracket 61 may have a j-shape with face portion 65*a*, horizontal portion 65*b* and rear portion 65*c*. Face portion 65*a* includes hole 62 discussed above. Conduit hole 66 may be cut into horizontal portion 65*b* so that electrical or other lines or services may extend to the electrical or other outlet 33, or further along through member 31.

If the user chooses not to install electrical outlets 33, a cover plate may be installed over member face hole 46 to protect any wiring, utility or tubing therein. And as discussed later, to minimize any chemical or other infiltration to the wiring and generally the interior of member 31, the user may also install bracket fillers 80 to seal off any unused slots 44 in member 31.

The ability of members 31 to distribute services is now more fully discussed. As described above, members 31 preferably include interior channels 48*a,b* through which many different types of services may extend and be delivered to the desired location within the laboratory or other type of room. Thus framework 30 performs both structural support and service distribution functions.

This dual function capability is a distinct departure from current shelving systems which perform neither of these functions or at most, just one. Indeed, framework for current shelving systems must typically rely on adjacent walls or other foundational supports for their structural integrity.

Also in current shelving systems, most frameworks are not even equipped to distribute services. While various existing framework members may include internal hollow portions, these internal spaces are typically too small to allow services to extend therethrough in a safe manner. And with these existing hollow spaces, even if wires are inserted therein, the hollow space is often impeded by various structural elements of the framework thereby preventing services from extending therethrough. Furthermore, any service distribution contemplated by such existing frameworks is limited to services such as electricity and telephony, and cannot accommodate services such as liquids and gases as can the current invention.

In any event, hollow spaces in existing framework members typically would not offer adequate protection for services. For example, such hollow spaces are not isolated from the tabs of brackets being inserted into the framework member. Thus a bracket tab could puncture or otherwise damage a service line. Furthermore, such hollow spaces are not divded into multiple channels as are channels 48*a,b*. Thus multiple services that are not compatible, e.g., electricity and water, could not travel through the same hollow space.

Many existing frameworks have attempted to provide services by fitting add-on conduits such as wire troughs to the framework. However, such add-on conduits do not provide structural integrity and typically protrude over shelves, countertops or other work surfaces. Other frameworks run lines external to the framework member and then use a cover which attached to the member to enclose the lines. However, such covers do not provide strength and are merely asthetic in nature. Furthermore, such covers are often easily knocked off the framework member thus exposing the lines.

Still other existing frameworks have not even attempted to provide services at all and thus merely allow cables and other service lines to be simply strewn about the floor or shelf tops, or run exposed along walls and ceilings. In such scenarios, the potential for damage and injury is obvious.

Certain existing frameworks that are used to support wall panels in modular office wall systems, do allow an electrical line or the like to pass laterally through a framework member. In this situation however, the service is not extending axially through the framework member but merely providing a link, e.g., electrical connector, between successive wall panels. This is in sharp contrast to the current invention which allows services to extend throughout virtually the entire framework 30 so that services may be accessible anywhere in the laboratory or other room without the need for wall panels.

The ability of framework 30 to perform both structural support and services distribution functions provides numerous distinct advantages over typical current shelving systems. First, internal services avoid possible injury which could arise by someone tripping over lines laying on the floor. Internal services allows the room to be efficiently and neatly networked for data transmission between various computers, robotics or other instruments within the room. This also provides that the room may be networked to outside servers and other locations.

Second, disruption of delicate experiments or instruments is also avoided by eliminating the possibility of tripping over or bumping into service lines. This is especially beneficial for experiments and research projects which require data accumulation over long periods of time.

Third, shelf and counter space are preserved because there is no need to run cords, pipes or other add-on service delivery mechanisms, such as wire troughs, thereon. And with the current invention, members 31 enclose the services and replace the conduit usually needed to carry the service. Furthermore, the flush surfaces of framework 30 are preserved because no add-on service conduits need to be bolted or otherwise attached thereto.

Fourth, cleanliness of the room is greatly facilitated which is especially important where the room functions as a clean room. This is especially true where the room is to be hosed down or otherwise cleaned en masse. Because the services are run internally, hosing down the room would not create electrical shorts or other similar problems. Fifth, the aesthetics of the laboratory are greatly improved as there is no need for add-on service conduits nor are there loose cables laying around. Sixth, where the service lines are potentially dangerous such as where hydrogen is distributed, internal distribution avoids the danger associated with puncture or other disruption.

Seventh, distributing services internally avoids having to penetrate walls, floors or ceilings. This increases modularity and is especially useful when the room is intended to be temporary. This also renders shelving system 10 substantially independent from the building. That is, the user need not hunt around the building for electrical outlets, water spigots or other service outlets because they are all provided by framework 30. Thus the amount of interfacing and connection between the room and building is minimized.

Referring again to FIG. 4, it can be seen that dividing the interior of member 31 into two channels 48*a,b* allows multiple services to extend therethrough. Significantly, services which are distinctly different and incompatible may extend through the same member 31 without interfering with each other. Examples include water and electricity, different currents and different types of sensitive computer signals. As mentioned above, this could not safely occur with existing framework members that may happen to have a hollow portion.

Another unique aspect of the current invention is that channel divider 50 isolates internal channels 48*a,b* from bracket tabs 72. Thus in effect, member 31 includes a third internal channel, i.e., space or deep channel 53. This is advantageous because damage to service lines within channels 48 is avoided which otherwise might occur when tabs 72 are inserted through member slots 44. For example, a bracket tab which cuts into an electrical line could result in a potentially dangerous short. Isolation of channels 48 also protects the wiring or utility lines from chemical spills or other contact with corrosive chemicals or other harmful materials. Such isolation is also integral in receiving UL or other safety approval.

Another advantage of the current invention is that members 31 may be supplied to the user in a pre-wired or pre-plumbed configeration in anticipation of the user's needs. This avoids the need for time-consuming manual wiring of shelving system 10 at the laboratory or room. To further ease installation, the services in members 31 are preferably configured uniformly. That is, a certain type of service such as electricity may always be located in the left channel 48*a* while another type of service such as water may always be located in the right channel 48*b*. Thus when constructing framework 30, confusion on how the internal services are configured is reduced.

The importance of avoiding randomly located wires about the floor and shelves cannot be overemphasized when considering the nature of today's laboratories. That is, many current laboratories do not function as laboratories in the classic sense where chemical experiments and the like are performed. Instead, many laboratories are required to provide a stable environment where information can be networked and equipment can be controlled.

An example involves pharmaceutical applications where containers of materials undergo stability testing for FDA approval. Here, the material container may be placed on a shelf and subjected to various temperatures, light intensities, humidities and other parameters to prove that the material is stable under various environments and conditions. Thus there is no real laboratory in a classic sense. Rather, it is a situation where power must be delivered to potentially many shelves to control environmental parameters, and material stability data must be collected from each shelf.

To meet these requirements in existing laboratories, wires are typically strewn about the floor and shelves, thereby creating the risks mentioned above. And here, the risks include losing or otherwise disrupting important test data collected over a long period of time should a user trip over and dislodge a data transmission line. However, the services distribution capability of framework 30 avoids these risks and provides the foregoing benefits. To this end, members 31 may distribute services all the way from a floor to a ceiling. Members 31 may also include brackets 35 to provide external services.

As mentioned above, housing 42 include whatever cutouts, holes, parts or attachment devices that are necessary to provide entrance and exit of any desired service. These may include power plugs, phone jacks, compression or other fittings for liquids and gases and other service connectors. Thus framework 30 provides the user with an independent source of is services without the need to search for such outlets in the building itself. Furthermore, service connections at the top, bottom, or other location of member 31 allow the services in successive members 31 to be easily connected to form a service network.

The isolation, self-containment and accessibility of the internal services is now further discussed. Referring again to FIGS. 3 and 4, member 31 may include back plate 54 connected to the sides of housing 42 to provide relative self-containment of channels 48*a,b*. Also for containment purposes, member 31 may also include end cap 55 as shown in FIG. 1. And where electrical or other outlets do not occupy holes 46, suitable cover plates may be attached thereover.

Back plate 54 and end cap 55 may be easily removed thereby providing accessibility to the services contained therein. And if necessary, shelves 90 can be easily removed to provide additional access. Services may thus be easily added, removed or otherwise altered. This is in sharp contrast to existing shelving systems in which services may extend above the ceiling, through the walls or through the floor. Thus in the current invention, where services need to be maintained or changed, tasks such as removing ceiling tiles or digging up floors are eliminated.

Figure 8:
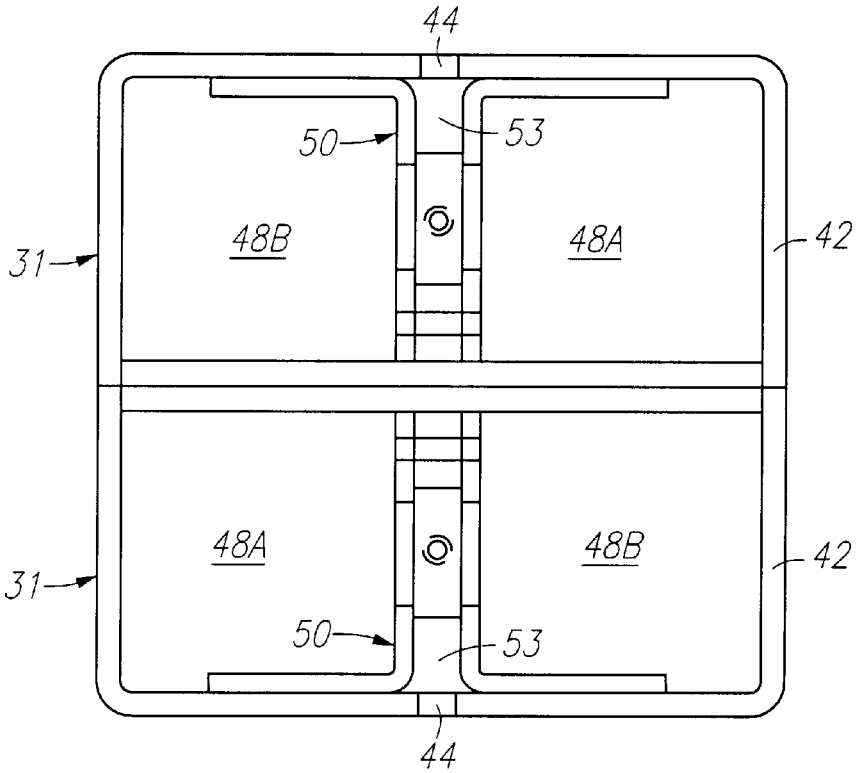
FIG. 8 shows two members arranged back-to-back in a top view.

Referring now to FIG. 8, two members 31 may be connected back-to-back thereby forming a self-contained square configuration. Here, back plates 54 may or may not be used thereby providing up to four independent service channels. The back-to-back arrangement of FIG. 8 is especially suitable for the shelving system island configuration shown in FIG. 2.

The self-containment of channels 48*a,b* allow a positive pressure to be maintained inside member 31 to avoid explosive or other dangerous gases from entering. This self-containment also allows channels 48 to be purged to eliminate any residue from an earlier service so that a new service may be installed.

Channels 48*a,b* may also be adequately self-contained in order to meet the NEMA-4 standard which requires that conduits housing electrical wiring and the like be weatherproof. To this end, the containment may be adequate for waterproofing in order to meet the appropriate NEMA standard. This is advantageous because shelving system 10 may be hosed down when cleaning the laboratory without fear of electrical shorting or other problems.

Preferably, channels 48*a,b* may also be rendered air tight if such a level of containment is desired. This advantageously provides that various gases or fluids may pass directly through member 31 to outlet 33 as shown in FIG. 1 without the need for any internal tubing. Alternatively, tubing (not shown) may extend through channels 48 and may be coupled to appropriate outlets to provide gas or fluid services. It should be noted that any hollow portions which may exist in current framework members are not adapted to provide the foregoing benefits provided by channels 48*a,b*.

Referring back to FIG. 1, members 31 may also be equipped with a box 56 which may comprise a transmitter/ receiver. Box 56 may thus emit appropriate signals, e.g., 900 MHz or infrared, to computers and/or other networked devices contained in the room. Box 56 may be attached to member 31 prior to delivery to the user, and may also be coupled to the electrical lines or other services running within member 31. Alternatively, box 56 may comprise a voltage line conditioner, surge suppressor to avoid power spikes or other similar item. To this end, it is preferred that each member 31 include a surge suppressor or circuit breaker located at some location on or within member 31.

Brackets 70 are now discussed in more detail with reference to FIGS. 1, 1*a*, 2 and 9–13. As shown in FIGS. 1, 1*a* and 2, each shelf 90 may be secured to framework 30 via brackets 70. Brackets 70 may be of various sizes and shapes according to the strength necessary to support the load resting on shelf 90. Brackets 70 may also exhibit different configurations so that they may support a shelf 90 from above as shown in FIGS. 9*a,b* and 10*a,b*, or from below as shown in FIGS. 11*a,b* and 12*a,b*.

Brackets 70 generally include wall 71 which may be formed in the shapes shown in the figures or in another shape. It is preferred that brackets 70 comprise epoxy-coated steel to provide the chemical and spill-resistance, rust avoidance and strength capabilities discussed above. As shown in FIGS. 9–12, wall 71 may extend above or below shelf 90 thereby providing flexibility in mounting.

Each bracket 70 preferably includes a series of tabs 72 located at that end of wall 71 which are intended to be inserted through slots 44 of members 31 into space or deep channel 53. Tabs 72 are generally spaced to correspond to the distance between successive slots 44 or some interval of slots 44.

Bracket 70 preferably includes lip 74 that extends perpendicularly from and along the length of wall 71 as shown in FIGS. 9–12. Lip 74 provides a surface on which shelf 90 may rest. For ease of manufacturing, it is preferred that lip 74 be contiguous with wall 71 so that it may be formed by a bending or folding operation. Alternatively, lip 74 may comprise a separate piece which may be perpendicularly attached to wall 71. Depending on which end of shelf 90 the bracket will support, lip 74 may extend either to either the left side of wall 71 as shown in figures 10*a,b* and 11*a,b*, or to the right side of wall 71 as shown in FIGS. 9*a,b* and 12*a,b*.

In one embodiment of the current invention, tab 72 is dimensioned such that the combined thickness of two tabs 72 is substantially equal to the width of slot 44 thereby resulting in a "single slot" configuration, i.e., only one slot is necessary to support successive shelves. Thus for bracket 70*b* (in FIG. 1), a left bracket and right bracket may be inserted into the same slot 44 thereby providing support for successive shelves. And for end locations such as brackets 70*a,c* (in FIG. 1), the appropriate bracket 70 may be used along with bracket filler 80 as shown in FIG. 13. Bracket filler 80 preferably includes the tab and notch arrangement discussed below to provide a sealing effect for all slots 44 not filled by brackets 70.

The single slot configuration represents an advance over existing shelving systems in which support columns typically have two rows of slots extending down the column. There, a left bracket is inserted into one slot and a right bracket is inserted into the other slot to support successive shelves. This dual slot configuration has several drawbacks. First, more slots increases the chance for contamination. Second, manufacturing costs for the columns are also increased due to more machining operations. Third, a gap exists between the brackets which detracts from overall stability of the shelving system.

The single slot configuration of the current invention overcomes these problems. It should be noted that the lack of gaps between shelves of system 10 contributes to overall stability thereby aiding compliance with earthquake regulations and also protecting expensive equipment.

Bracket 70 may alternatively include lips 74 extending to both the left and right where bracket 70 is to support ends of consecutive shelves, i.e., bracket 70*b* in FIG. 1. Here, it is preferred that the thickness of tab 72 be doubled so that it again matches the width of slot 44 and space or deep channel 53 for stability and protection against contamination.

Each tab 72 preferably includes a notch 73 which provides an interlocking effect between brackets 70 and members 31. That is, after tabs 72 are inserted through slots 44, bracket 70 is then slid down by a distance equal to the depth of notch 73 so that the upper end of notch 73 engages the lower end of slot 44.

Once in this downward position, the weight of brackets 70 and shelf 90 helps maintain this interlocking engagement. However, it is also preferred that the gap resulting between the top of bracket tab 72 and the top of slot 44 be plugged by a grommet 81, some other type of plug or a filler material. This maintains bracket 70 in the downward position. This interlocking effect is advantageous because it provides stability and helps shelving system 10 to comply with earthquake regulations.

Other aspects of the interlocking between brackets 70 and members 31 are now described. It is preferred that tabs 72 be long enough so that they protrude into member 31. More specifically, tabs 72 preferably extend into space or deep channel 53 as shown in FIG. 4. To this end, it is preferred that the depth of channel 53 and the length of tab 72 that is inserted are adequate to provide lateral stability and prevent "wagging". It is also preferred that the space between flanges 51*a,b* is substantially equal to the thickness of two tabs 72 to ensure a snug fit. This too prevents "wagging" or other lateral movement of bracket 70 relative to member 31 thereby providing stability and aiding compliance with earthquake regulations.

Figure 18A:
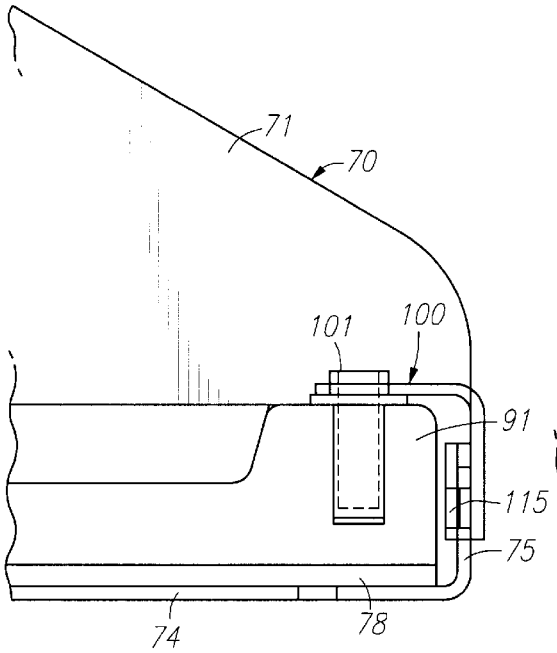

Preferably, lip 74 is lined with some type of cushion, shock-absorbing or vibration-dampening material 78 as best shown in FIG. 18*a*. Padding 78 may comprise rubber, urethane, high-density urethane, hollow cushions, air support devices or other materials or mechanisms. To this end, air support devices are preferred where the anticipated vibrations are of low frequency. Padding 78 helps isolate the bottom of shelf 90 from any vibrations that may be transmitted through framework 30 and/or bracket 70, thereby protecting delicate instruments, materials or experiments that may be located on shelf 90. This again helps compliance with earthquake regulations.

As shown in the figures, bracket retaining barrier 76 may extend perpendicular to lip 74, and may be separated from wall 71 by a space, best shown in FIGS. 9*a* and 10*b*. Again for manufacturing ease, barrier 76 is preferably contiguous with lip 74 and may be formed by a folding operation due to the spacing from wall 71. Thus, consecutive folding operations may serve to form lip 74 and barrier 76. The equipment-containing function performed by retaining barrier 76 also helps compliance with earthquake regulations.

Wall 71, lip 74 and bracket retaining barrier 76 collectively allow the user to securely position shelf 90 between two brackets 70 as shown in FIG. 1. That is, lip 74 supports shelf 90 from the bottom, while walls 71 and bracket 76 restrain shelf 90 from the sides and front, respectively. Furthermore, members 31 restrain shelf 90 from the rear.

The spill and equipment-containment function provided by this configuration helps shelving system 10 comply with earthquake regulations. As discussed below, it is preferred that shelf 90 be sized so that it snugly fits within brackets 70 but still easily for modularity purposes.

Bracket 70 of the current invention also provides the following benefits. The interlocking feature provided by tabs 72, notches 73, slots 44 and deep channel space 53 generally eliminates the need for invasive fasteners such as screws or nails that are typically used in existing systems to fasten a shelf to a support. This lowers cost and facilitates the assembly and disassembly of shelving system 10 as shown in figure 1*a* for easy laboratory reconfiguration or for disassembling when cleaning. Modularity is thus achieved.

Furthermore, by removably assembling bracket 70 and member 31 as shown in FIG. 1*a*, there is no need for invasive fasteners, and a greater variety of shelf materials may be used. Thus materials such as epoxy, composites or other stiff materials that have a high bending moment but that do not readily accept screws or nails, may now be used in shelving system 10. The user may thus benefit from the chemical-resistance, strength and other advantageous properties of epoxy and similar materials. And with regard to the increased strength of shelves comprising epoxy and the like, shelves 90 may be longer thus decreasing the number of shelves, support brackets and associated framework needed in the first place.

Bracket fillers 80 are now more fully discussed with reference to FIG. 11. In addition to being located at the end of a row of shelves 90, bracket fillers 80 may also be used to plug up any other slots 44 that do not accommodate brackets 70. Bracket fillers 80 may comprise the same material as brackets 70. Though a two-tabbed bracket filler 49 is shown in FIG. 11, bracket fillers 80 may include any number of tabs 72 to suit any number of open slots 44. Furthermore, bracket fillers 80 may include hooks, shelves or other physical features (not shown) for hanging, storing or otherwise locating instrumentation, services or other equipment.

After brackets 70 and bracket fillers 80 have been inserted to plug all slots 44, shelving system 10 may be hosed down without fear of condensation within members 31 and damage to the services contained therein. Plugging all slots 44 also helps prevent contamination. To ensure plugging of slots 44, bracket and bracket filler tabs 72 may be fitted with a grommet (not shown) or other spacer which is compressed upon being inserted into slot 44.

Referring now to FIGS. 14–17, shelf 90 is more fully described. Shelf 90 preferably comprises epoxy which provides greater strength than standard shelf materials as well as chemical and spill-resistance. For example, an epoxy silica mixture may be used. While epoxy is discussed in detail below, materials other than epoxy such as various metals, polymers, plastics and composites may be used for shelf 90, e.g., polypropolyne, polyethylene, teflon and fiberglass.

The use of epoxy rather than existing materials for shelf 90 provides many benefits in and of itself. For example, steel shelves are very expensive and will typically rust over time, while plastic laminate and wood shelves may eventually delaminate. Advantageously, epoxy maintains its form and appearance. Furthermore, none of these existing materials exhibit the stiffness and strength characteristics discussed below. Still further, epoxy provides electrical isolation whereas steel and other types of metal shelves are conductive.

Epoxy's greater shelf strength allows increased shelf spans between members 31. To this end, it is contemplated that epoxy shelves 90 may be four or more feet long (which is substantially longer than the current three foot standard shelf length) and still support a 50 pound per square foot load. Other loads are contemplated depending on the desired thickness of shelf 90 which may vary. This represents a significant advance because fewer standards 31 are required thereby reducing cost of the overall shelving system 10. That is, any increase in shelf cost due to the use of epoxy instead of wood, plastic laminate or other material, is more than offset by the reduction in material cost due to fewer members 31 being used.

Furthermore, installation time for shelving system 10 is decreased because fewer members 31 need be erected. Still further, in the wall-mounted configuration of FIG. 1, requiring fewer members 31 means that fewer wall studs need be located for mounting purposes. This alleviates problems where wall studs are not correspondingly located at desired member 31 locations.

Greater shelf strength also provides that shelves 90 may be deeper thereby providing increased shelf space. This is especially useful to support bulky computer or other equipment that are prevalent in today's laboratories, as well as to provide increased storage capacity for applications such as the FDA stability testing discussed above.

The use of epoxy advantageously also allows shelf 90 to be molded into a variety of different shapes and sizes. For example, shelf 90 may be molded in different thicknesses thereby providing necessary strength for longer or shorter shelf spans. As another example, shelf 90 may be molded to include multiple corners, edges, cut-outs or other features. This is an advance over existing materials because where greater shelf strength has been desired, materials exhibiting adequate strength such as steel have been required. However, such materials are typically not easily machined or otherwise formed to provide such shapes or features. Furthermore, steel rusts and is susceptible to corrosion upon contact with chemicals.

In one preferred embodiment as shown in FIG. 14, shelf 90 is molded such that peripheral lip 91 surrounding recessed portion 92 is formed. Recessed portion 92 is best seen from the FIG. 16 side section view. This configuration contains chemical or other spills within shelf 90, and prevents liquids from spilling over shelf 90 and onto delicate devices such as a computer. A distinct advantage of such a peripheral lip 90 is that spills are contained in all directions and not just in the front of the shelf. It should be noted that shelf 90 may also be used in solvent cabinets 120 that may be hung from framework 30. Here, the peripheral lip provides containment of any spill solvent.

Lip 91 also provides an equipment-containment function by helping prevent objects from falling off shelf 90. And because shelf 90 may be molded, lip 91 need not comprise separate pieces requiring attachment to shelf 90. In an alternative embodiment, shelf 90 may comprise a flat base and a tray mounted thereon. This embodiment still provides the spill and equipment containment feature. Where no lip is necessary, the preferred shelf may simply have a flat surface as shown in FIG. 15.

Notches 93 are preferably cut, molded or otherwise formed into shelf 90. Notches 93 accommodate members 31. Thus shelf 90 is securely positioned between members 31, and within the walls 71, lips 74 and bracket retaining barriers 75 of successive brackets 70. Accordingly, shelf 90 is securely positioned without the need for screws or other invasive attachment means which are typically not easily used with epoxy materials. However shelves 90 may still be easily removed for imodularity.

Shelf 90 may also include holes 94 to receive retaining barriers 95 as shown installed into shelves 90 in FIG. 1, or to receive bushing inserts 101 as discussed below. Retaining barriers 95 may comprise a rod which is shaped into an inverted "U" thereby providing a type of fence along the front of shelf 90 to prevent items from falling off. Two retaining barriers 95 may be used for each shelf 90, though one or some other number of barriers 95 may be used. Lip 91 and retaining barrier 95 may thus help in compliance with earthquake regulations.

It should be noted that a variety of epoxy shelf shapes and sizes may be molded and used in addition to those shown in the figures. For example, where members 31 are positioned in the middle of a room, e.g., in the island configuration, shelf 90 may be comprise a "double" shelf as shown in FIGS. 2, 15 and 17 which would extend in both directions from members 31. To this end, the double shelf may be configured differently on each side to suit the user's needs.

Referring now to FIGS. 1*a*, 18*a–d*, 19 and 20, retaining clip assembly 100 to interlocking shelf 90 with bracket 70 is described. This interlocking feature provides extra rigidity of shelving system 10 and helps prevent wagging or other lateral movement of shelf 90 while still allowing easy disassembly. Retainer clip assembly 100 generally includes bushing insert 101 and clip 110.

As shown in FIG. 19, bushing insert 101 includes lower portion 103, annular portion 104, upper portion 105 and bore 106 extending therethrough. As shown in FIG. 20, clip 110 includes curved flanges 111*a,b*, upper and lower notches 112*a,b* formed in flanges 111, upper flange 113 and hole 114.

FIGS. 18*a–d* are different views of assembly 100 when shelf 90 rests on padding 78 and lip 74 of bracket 70. Bushing insert lower portion 103 may be inserted into shelf hole 94 such that annular portion 104 rests on the surface of shelf 90. Clip 110 may then be snapped into place so that curved flanges 111*a,b* surround and engage bracket retaining barrier 76, and so that clip hole 114 fits over upper portion 105 of bushing 101. It is preferred that the fit between bushing 101, clip 110 and bracket retaining barrier 76 be snug to provide interlocking and stability.

Clip 110 may be secured in place by one of notches 112*a,b* engaging barrier knob 115 which is coupled to retaining barrier 76. Retaining barriers 95 may then be inserted into successive bushing holes 106. Bushing 101 may remain inserted in shelf 90 regardless of whether retaining barriers 95 are removed. Thus, the interlocking feature remains despite removal of barriers 95.

Figure 18B:
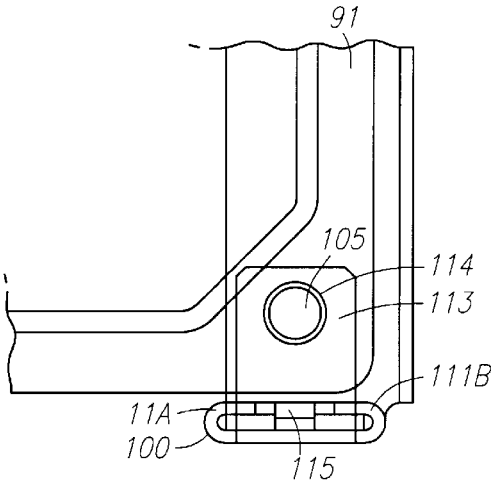
Figure 18C:
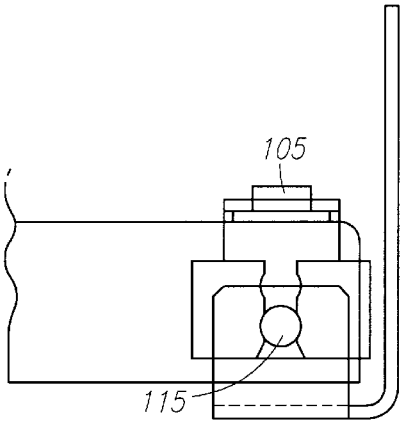
Figure 18D:
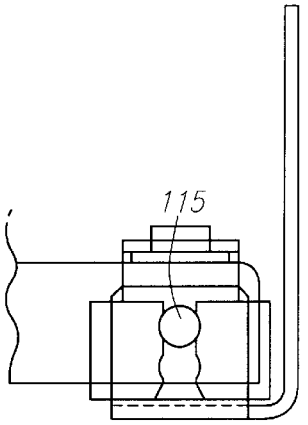

FIG. 18*a–c* show a shelf 90 having a peripheral lip 91 while FIG. 18*db* shows a shelf without a lip. FIG. 18*d* shows clip 110 securing a thin shelf 90 (not having a peripheral lip 91) such that the clip upper notch 112*a* engages knob 115. FIG. 18*c* shows clip 110 securing a thick shelf (having a peripheral lip 91) such that the clip lower notch 112*b* engages knob 115. Thus it can be seen why clip 110 preferably includes two notches 112 so that shelves 90 of varying thickness may be secured.

In another embodiment of retaining clip assembly, no bushing insert 101 is used and clip 110 need not include notches 112*a,b*. Here, clip 110 still includes curved flanges 111*a,b* and engage bracket retaining barrier 76. Clip 110 also includes upper flange 113 and hole 114. Here, flange 113 is preferably configured and sized so that its bottom surface abuts the top surface of shelf 90. After installing clip 110, hole 114 then accommodates retaining barrier 95 and is preferably sized so that its inside diameter significantly corresponds to the outside diameter of barrier 95.

A significant advantage provided by retaining clip assembly 100 is the stability and strength it provides without the need for invasive fasteners such as screws to connect shelf 90 with bracket 70. Stability is provided despite allowing easy disassembly as shown in FIG. 1*a*. This greatly decreases installation time and also allows quick removal of shelves 90.

Referring back to FIG. 1, it is shown that cabinet 120 is preferably adapted to hang from framework 30. To this end, the back side of cabinet 120 may be fitted with a tab/notch arrangement similar to that described in connection with bracket 70. In this manner, tabs of cabinet 120 are inserted into slots 44 and lock in the same manner. Such modularity represents a significant advance in that many current cabinets are epoxied or otherwise fixedly attached to floor 12 which hinders reconfiguration of a laboratory or other room.

Cabinetry 120 may comprise different forms as shown in FIG. 2. And to help contain spills, countertop 122 and/or members 31 may be fitted with backsplash 124. Backsplash 124 may be located between vertical members 31 as shown, in front of vertical members 31 or in some other location. Backsplash 124 may comprise epoxy or other suitable material. In this configuration, backsplash 124 may derive structural support from members 31.

It will be apparent from the foregoing that, while particular forms of the invention have been illustrated and described, various modifications can be made without departing from the spirit and scope of the invention. Accordingly, it is not intended that the invention be limited, except as by the appended claims.

What is claimed is:

1. A framework, comprising:

a plurality of structural members coupled together in an arrangement capable of supporting a load, at least one member having an internal channel contained and enclosed within the at least one member, through which a service is distributed;

wherein the plurality of members are arranged to form a framework grid of adjacent walls comprising horizontal and vertical members;

at least one overhead member coupled to the top of the framework grid of adjacent walls thereby forming a framework grid for a self-standing room;

wall panels attached to the framework grid of walls, and ceiling panels attached to the overhead member thereby forming a self-standing room; and ducting, HVAC and lighting supported by the framework grid for the self-standing room thereby forming a functional room.

2. A framework, comprising:

a plurality of structural members coupled together in an arrangement capable of supporting a load, at least one member having an internal channel contained and enclosed within the at least one member, through which a service is distributed; and wherein the members comprise a corrosion-resistant material comprising one of epoxy-coated steel, stainless steel or fiberglass.

3. A framework, comprising:

a plurality of structural members coupled together in an arrangement capable of supporting a load, at least one member having an internal channel contained and enclosed within the at least one member, through which a service is distributed;

a plurality of brackets removably coupled to at least several of the members;

a plurality of shelves removably coupled to the brackets; and a plurality of retaining clips removably coupled to an adjacent shelf and bracket interlocking the shelf to the bracket.

4. A structural member for use in a framework, the structural member comprising:

a rigid housing capable of supporting a load and including at least one internal channel contained and enclosed by the housing through which a service is distributed; and a surge suppressor, a transmitter or a receiver.

5. A structural member for use in a framework, the structural member comprising:

a rigid housing capable of supporting a load and including at least one internal channel contained and enclosed by the housing through which a service is distributed; and an anti-vibration mechanism attached to the housing at a point where the housing contacts a wall or ceiling.

6. A structural member for use in a framework, the structural member comprising:

a rigid housing capable of supporting a load and including at least one internal channel contained and enclosed by the housing through which a service is distributed;

wherein the housing comprises a corrosion-resistant material comprising one of epoxy-coated steel, stainless steel and fiberglass.

* * * * *